US007158716B2

(12) United States Patent
Shapiro et al.

(10) Patent No.: US 7,158,716 B2
(45) Date of Patent: Jan. 2, 2007

(54) PORTABLE PEDESTAL ELECTRIC HEATER

(75) Inventors: Barry Shapiro, Doylestown, PA (US); William E. Lasko, Chester Springs, PA (US); Paul W. Orr, Coatesville, PA (US)

(73) Assignee: Lasko Holdings, Inc., Wilmington, DE (US)

( * ) Notice: Subject to any disclaimer, the term of this patent is extended or adjusted under 35 U.S.C. 154(b) by 0 days.

(21) Appl. No.: 10/855,697

(22) Filed: May 27, 2004

(65) Prior Publication Data

US 2004/0218912 A1 Nov. 4, 2004

Related U.S. Application Data

(63) Continuation-in-part of application No. 10/720,374, filed on Nov. 24, 2003, which is a continuation-in-part of application No. 10/431,964, filed on May 8, 2003, now Pat. No. 6,942,456, which is a continuation-in-part of application No. 10/347,079, filed on Jan. 17, 2003, which is a continuation-in-part of application No. 10/322,169, filed on Dec. 18, 2002, now Pat. No. 6,760,543.

(60) Provisional application No. 60/523,369, filed on Nov. 19, 2003.

(51) Int. Cl.
*F24D 15/02* (2006.01)

(52) U.S. Cl. ..... 392/365; 392/382

(58) Field of Classification Search ..... 392/379–385, 392/365–369, 360, 352–353; 34/90; D23/337, D23/332, 335–336
See application file for complete search history.

(56) References Cited

U.S. PATENT DOCUMENTS 1,429,130 A 9/1922 Dutton (Continued)

FOREIGN PATENT DOCUMENTS

DE 863 112 C 1/1953

(Continued)

OTHER PUBLICATIONS

International Search Report for PCT International Application No. PCT/US2004/019803, mailed Nov. 24, 2004.

*Primary Examiner*—Thor Campbell
(74) *Attorney, Agent, or Firm*—Woodcock Washburn LLP

(57) ABSTRACT

A portable pedestal electric heater apparatus for providing a heated exhaust air stream at an elevation above a support surface comprises a tower electric heater and a support riser for supporting the tower electric heater at an elevation above a support surface. The tower electric heater comprises an elongate housing and at least one interior space within the elongate housing. At least one inlet opening in the elongate housing allows inlet air to enter the at least one interior space. An air blower assembly is disposed within the at least one interior space for receiving the inlet air. An air outlet opening in the housing allows the exhaust air stream to exit the at least one interior space. An electric heating element is disposed within the at least one interior space between the air blower assembly and the air outlet opening such that substantially all of the exhaust air stream passes through the electric heating element and thermal energy is transferred from the electric heating element to the exhaust air stream as the exhaust air stream flows through the electric heating element forming the heated exhaust air stream. An elevation of the heated exhaust air stream is defined by a distance from where the support riser contacts the support surface to a vertical midpoint of the air outlet opening in the housing of the tower electric heater, and the elevation of the heated exhaust air stream is about 14 inches or greater.

63 Claims, 12 Drawing Sheets

U.S. PATENT DOCUMENTS

| | | | | | |
|---|---|---|---|---|---|
| 2,255,759 | A | | 9/1941 | Carpenter | |
| 2,375,920 | A | * | 5/1945 | Hewitt | 417/363 |
| 2,471,784 | A | | 5/1949 | Seifner et al. | |
| 2,824,429 | A | | 2/1958 | Zucker | |
| 3,085,350 | A | * | 4/1963 | Waters | 34/91 |
| 3,175,550 | A | | 3/1965 | Knapp | |
| 3,251,540 | A | | 5/1966 | Kinsworthy | |
| 3,267,255 | A | | 8/1966 | Schultz | |
| 3,290,112 | A | | 12/1966 | Gillenwater et al. | |
| 3,575,582 | A | * | 4/1971 | Covault | 392/356 |
| 3,643,346 | A | * | 2/1972 | Lester | 34/202 |
| 3,725,640 | A | | 4/1973 | Kunz | |
| 4,703,152 | A | * | 10/1987 | Shih-Chin | 392/366 |
| 4,743,739 | A | | 5/1988 | Tateishi | |
| 4,780,595 | A | * | 10/1988 | Alban | 392/381 |
| 4,900,898 | A | | 2/1990 | Kling | |
| 5,083,011 | A | | 1/1992 | Munroe | |
| 5,192,853 | A | * | 3/1993 | Yeh | 219/540 |
| 6,079,949 | A | | 6/2000 | Litvin | |
| 6,321,034 | B1 | * | 11/2001 | Jones-Lawlor et al. | 392/367 |
| RE37,642 | E | * | 4/2002 | Goldstein | 392/367 |
| 6,480,672 | B1 | * | 11/2002 | Rosenzweig et al. | 392/365 |
| D468,005 | S | * | 12/2002 | Bailey | D23/328 |
| D481,783 | S | * | 11/2003 | Fok | D23/328 |
| D483,457 | S | * | 12/2003 | Wang | D23/336 |
| 6,760,543 | B1 | * | 7/2004 | Orr et al. | 392/365 |
| 6,842,581 | B1 | * | 1/2005 | Schafer | 392/380 |
| 6,973,260 | B1 | * | 12/2005 | Orr et al. | 392/365 |
| 2003/0128971 | A1 | | 7/2003 | Birdsell et al. | |
| 2004/0197091 | A1 | * | 10/2004 | Orr et al. | 392/365 |

FOREIGN PATENT DOCUMENTS

| | | | | |
|---|---|---|---|---|
| DE | 3200217 | | * | 7/1983 |
| EP | 0 072 663 | A1 | | 2/1983 |
| EP | 0 417 309 | A1 | | 3/1991 |
| EP | 0 745 814 | A2 | | 12/1996 |
| FR | 993168 | | | 10/1951 |
| FR | 1502108 | A | | 11/1967 |
| FR | 2136153 | | * | 11/1972 |
| GB | 265279 | A | | 2/1927 |
| GB | 1037098 | A | | 7/1966 |
| GB | 2 037 418 | A | | 7/1980 |
| JP | 61-243254 | | * | 10/1986 |
| JP | 4-84069 | | * | 3/1992 |
| WO | 03/009735 | | * | 2/2003 |
| WO | WO 03/078846 | A1 | | 9/2003 |

* cited by examiner

PORTABLE PEDESTAL ELECTRIC HEATER

This application claims priority to provisional application No. 60/523,369, filed Nov. 19, 2003. This application is also a Continuation-in-Part of application Ser. No. 10/720,374, filed Nov. 24, 2003, which is a Continuation-in-Part of application Ser. No. 10/431,964, filed May 8, 2003 now U.S. Pat. No. 6,942,456, which is a Continuation-in-Part of application Ser. No. 10/347,079, filed Jan. 17, 2003, which is a Continuation-in-Part of application Ser. No. 10/322,169, filed Dec. 18, 2002 now U.S. Pat. No. 6,760,543.

FIELD OF THE INVENTION

This invention relates generally to heaters. More specifically, the present invention relates to an elongate electric heater elevated above a support surface in which thermal energy is imparted to exhaust air as it passes through a heating element.

BACKGROUND OF THE INVENTION

Portable heating devices have been utilized to raise the temperature in a living space for many years. Conventional portable forced hot air heaters for consumer use are well-known and are comprised of an electrical heating element and a fan within a housing. Ambient air is forced to pass through or over the heating element thus raising the temperature of the air. As sufficient air passes through the heating element the ambient temperature of the room is raised as desired.

One type of conventional portable heater is normally low in elevation with respect to a support surface, such as the floor. This low profile increases the distance that the heat must travel (i.e., the heat path) to reach the upper trunk of the users body. The added heat path distance does not produce the desired effect of heating the upper trunk and extremities of the user body efficiently.

Another type of conventional heater utilizes a transverse air impeller assembly. This type of heater attempts to raise the exit height of the hot air exhaust stream with respect to the floor. One drawback of this type of air circulator is that transverse air impeller assemblies typically have several sections which must be coupled together by glue or ultrasonic welding. This assembly must then be balanced to insure correct operation. Transverse air impeller assemblies may also necessitate the use of vibration dampers on the motor. In addition, long transverse air impeller assemblies tend to become misaligned, thereby requiring a special bearing mounted in rubber pads to compensate for the misalignment. The above mentioned problems are exacerbated as the length of the transverse air impeller assembly is increased, which limits the elevation that the heated exhaust stream can be raised above the floor with a conventional tower heater design. These features and associated problems also add significant expense to the manufacturing process. The result is translated into a higher retail price and less desirable comfort levels for the consumer.

Conventional heaters that utilize a centrifugal blower assembly encounter similar manufacturing problems when the impeller length is increased. Shaft length of the motor, impeller balancing and the need for a more powerful motor to rotate the longer impeller increase manufacturing costs. These problems all result in higher retail prices for heaters having long centrifugal blower assemblies.

The design of conventional tower heaters therefore limits the vertical height of the heated exhaust air stream. This is caused, in part, because the cost and complexity of the devices increases as the length of the heating element and/or the length of the impeller increases.

In light of the aforementioned problems there is a need for a forced air heater having a heated exhaust air stream at a height sufficient to shorten the heat path to an upper portion of the user's body. This heating device should have a vertical aspect ratio while using an air generator with an impeller design having the desired air flow characteristics that allow ease of manufacturing and a desirable retail cost for the consumer.

SUMMARY OF THE INVENTION

In view of the shortcomings of the prior art the present invention is a portable pedestal electric heater apparatus for providing a heated exhaust air stream at an elevation above a support surface.

According to an aspect of the present invention, the apparatus comprises a tower electric heater and a support riser for supporting the tower electric heater at an elevation above a support surface. The tower electric heater comprises an elongate housing having at least one sidewall, a top end, a bottom end, and a longitudinal length extending substantially upward from the bottom end to the top end; and at least one interior space within the elongate housing. At least one inlet opening in the elongate housing allows inlet air to enter the at least one interior space. An air blower assembly is disposed within the at least one interior space for receiving the inlet air. An air outlet opening in the housing allows the exhaust air stream to exit the at least one interior space. An electric heating element is disposed within the at least one interior space between the air blower assembly and the air outlet opening such that substantially all of the exhaust air stream passes through the electric heating element and thermal energy is transferred from the electric heating element to the exhaust air stream as the exhaust air stream flows through the electric heating element forming the heated exhaust air stream. The support riser comprises a base in contact with the support surface; and at least one riser having a first end and a second end, the first end being connected to the base and the riser extending substantially upward from the first end to the second end, the second end being connected to the bottom end of the elongate housing. The support riser has a rise height defined by a distance from where the base contacts the support surface to the second end of the riser. An elevation of the heated exhaust air stream is defined by a distance from where the support riser contacts the support surface to a vertical midpoint of the air outlet opening in the housing of the tower electric heater, such that the elevation of the heated exhaust air stream is about 14 inches or greater.

According to another aspect of the invention, the air blower assembly further comprises either a centrifugal blower assembly, a transverse blower assembly or an axial fan type blower assembly According to a further aspect of the invention, the at least one air impeller further comprises a length and a diameter, and a ratio of the length to the diameter is greater than about 2:1.

According to yet a further aspect of the invention, the electric heater further comprises a controller for controlling a function of the portable pedestal electric heater.

According to still a further aspect of the invention, the motor further comprises a variable speed motor having one or more rotational speeds, and the controller controls the rotational speeds.

According to another aspect of the invention, the housing rotates or oscillates relative to the support surface, and the rotation or oscillation is about an axis of rotation, the axis of rotation being substantially aligned with a vertical longitudinal axis of the support riser.

According to yet another aspect of the invention, the axis of rotation of the housing is substantially parallel to the axis of rotation of the at least one impeller.

According to still another aspect of the invention, the axis of rotation of the housing is substantially perpendicular to the axis of rotation of the air impeller.

According to a further aspect of the invention, the electric heater further comprising a mechanism for rotating or oscillating the housing relative to the support surface with the mechanism being disposed between one of i) the first end of the riser and the base, and ii) the second end of the riser and the housing.

According to still a further aspect of the invention, the heater further comprises a grill covering the air outlet opening with air directing vanes that can be positioned to direct the exhaust air stream exiting the housing to a desired location.

According to yet a further aspect of the invention, an overall length of the portable pedestal electric heater is defined by the distance between where the support riser contacts the support surface and the top end of the housing, with the elevation of the heated exhaust air stream being greater than about 65% of the overall length.

According to another aspect of the invention, the rise height is greater than about 15% of the overall length.

According to another aspect of the invention, the rise height is greater than about 3.5 inches.

According to yet another aspect of the invention, the longitudinal length of the housing is less than about 85% of the overall length.

According to still another aspect of the invention, the elevation of the heated exhaust air stream is greater than about 70% of the longitudinal length of the housing.

According to a further aspect of the invention, the rise height is greater than about 25% of the elevation of the heated exhaust air stream.

According to yet a further aspect of the invention, the rise height is greater than about 16% of the longitudinal length of the housing.

According to still a further aspect of the invention, the air outlet opening further comprises an elongate air outlet opening in the at least one sidewall and oriented substantially along the longitudinal length of the housing, the elongate air outlet opening allowing the exhaust air to exit the interior space as an elongate exhaust air stream.

According to another aspect of the invention, the electric heating element is an elongate electric heating element, the elongate electric heating element being disposed proximate the elongate air outlet opening and oriented substantially along the longitudinal length of the housing, and wherein the elongate electric heating element further comprises a vertical aspect ratio defined by a length of the elongate electric heating element being greater than a width of the elongate electric heating element.

According to yet another aspect of the invention, the vertical aspect ratio of the elongate electric heating element is greater than about 2:1.

According to still another aspect of the invention, the elongate electric heating element has a length of about 5 inches or greater.

According to a further aspect of the invention, the elongate electric heating element is a positive temperature coefficient (PTC) heating element capable of producing about 1500 watts of energy.

According to yet a further aspect of the invention, the electric heater further emits a column of heated exhaust air having a flow pattern that substantially conforms to the vertical aspect ratio of the elongate electric heating element.

According to still a further aspect of the invention, the electric heater further comprising a power cord, where the power cord is routed through a central portion of the support riser and exits at a lower portion of the support riser.

According to another aspect of the invention, the support riser comprises an extension of the housing toward the support surface, and wherein the support riser remains assembled to the housing for shipment from a place of manufacturing to a place of sale.

According to yet another aspect of the invention, the electric heater further comprises an axis of rotation about which the elongate housing rotates or oscillates and a longitudinal center axis of the support riser, wherein the axis of rotation and the longitudinal center axis are substantially aligned.

According to still another aspect of the invention, a portable pedestal electric heater apparatus comprises an operating position, in which the portable pedestal electric heater is assembled and ready for operation, and a non-operating position, in which the portable pedestal electric heater apparatus is disassembled and packaged for shipment. In the operating position, the portable pedestal electric heater apparatus comprises a support riser, and a space saving tower electric heater mounted on top of the support riser. In the non-operating position the portable pedestal electric heater apparatus comprises the space saving tower electric heater being disconnected from the support riser and stored in a package for shipment.

These an other aspects will become apparent in view of the following description.

BRIEF DESCRIPTION OF THE DRAWINGS

The invention is best understood from the following detailed description when read in connection with the accompanying drawing. It is emphasized that, according to common practice, various features of the drawings are not to scale. On the contrary, the dimensions of various features are arbitrarily expanded or reduced for clarity. Included in the drawings are the following Figures

DETAILED DESCRIPTION OF THE INVENTION

Figure 1:
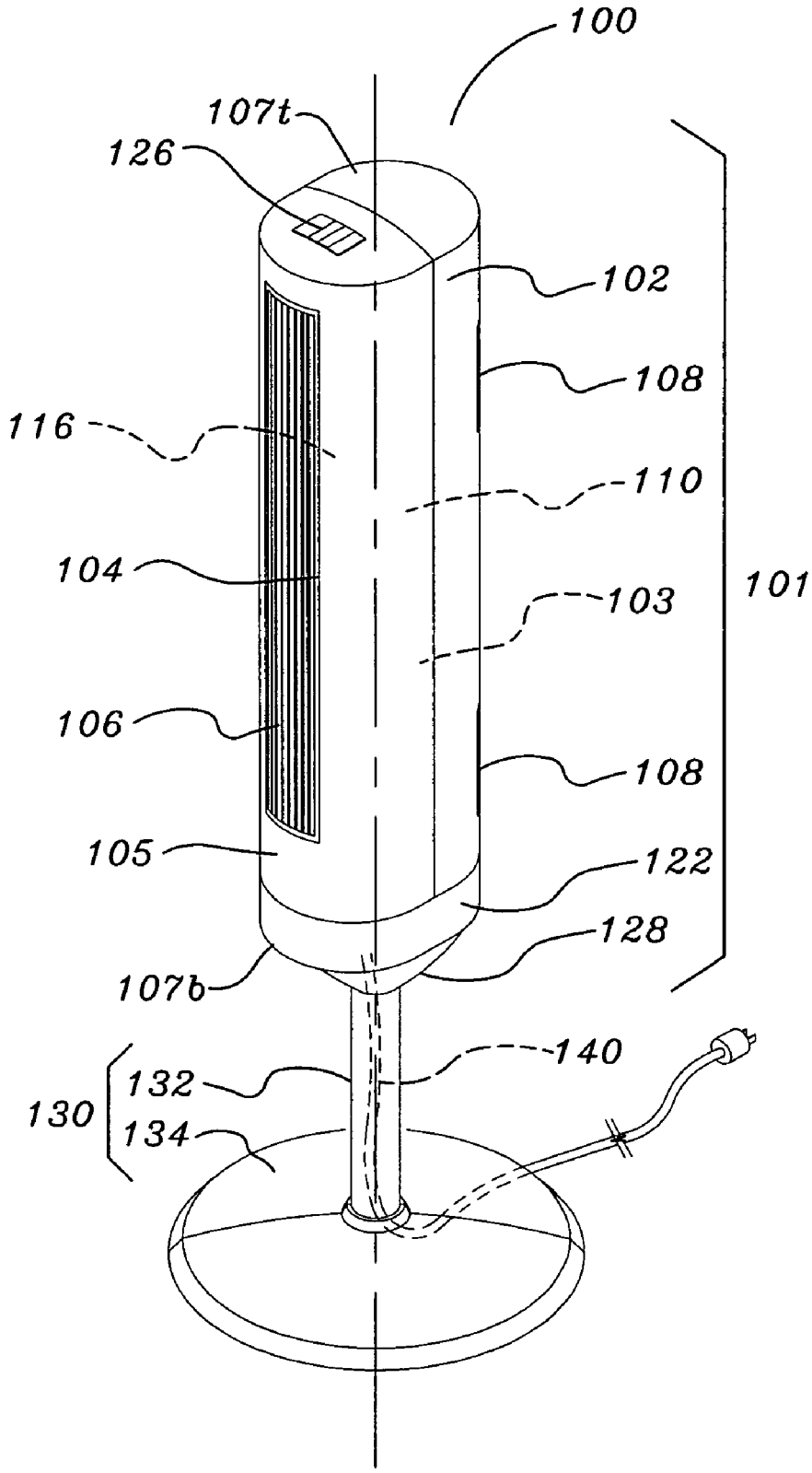
FIG. 1 is a perspective view of an exemplary embodiment of the portable pedestal electric heater of the present invention.

The following description is of a pedestal electric heater 100 that is preferably portable (e.g., free standing and easily movable). Referring now to FIG. 1, portable pedestal electric heater 100 includes a tower electric heater 101 and a support riser 130. The tower electric heater 101 includes an elongated housing 102 having a vertical aspect ratio, a heating element or elements 116, and an air blower assembly 110 for providing a heated exhaust air stream at a height above a support surface. The riser support 130 includes a base 134 and a riser 132 for further positioning the heated exhaust air stream at a height above a support surface, thereby allowing the generated heat to more immediately effect a portion of the user's upper body.

The combination of a tower type electric heater 101 mounted on top of a vertical support riser 130 shortens the heat path between the heating element and an upper portion of the user's body. Since the heat source is further elevated above a support surface and is more closely related to an upper portion of the body, the heat effect to the user is more direct and immediate.

The use of a tower electric heater 101 in conjunction with a support riser 130 to further elevate the heated exhaust air stream allows for flexibility in design of the individual components of the portable electric heater 100 while also providing for cost efficiency. For example, the length of the tower electric heater 101 and the length of the support riser 130 can be manipulated as desired for any particular application in order to obtain the desired heating design characteristics while also minimizing manufacturing cost. By using a support riser, the desired heating characteristics can be achieved at an elevation above a support surface while still maintaining cost efficiency in, for example, the air blower assembly design and the electric heating element design.

The pedestal electric heater 100 having a tower electric heater 101 also provides a space saving design over conventional heater and provides for a lower center of gravity thereby improving stability and minimizing the size of the base required to maintain the pedestal electric heater 100 in an upright position and thus avoid tipping of the apparatus.

Additional details of the structure of the elongate housing having a vertical aspect ratio, the elongate heating element, and the blower assembly impeller design can be found in commonly assigned, application Ser. No. 10/322,169, filed Dec. 18, 2002, entitled "Electric Heater", which is hereby incorporated by reference in its entirety.

Additional details of the structure of the support riser and the blower assembly impeller design can be found in commonly assigned, application Ser. No. 10/720,374, filed Nov. 24, 2003, entitled "home comfort device" and application Ser. No. 10/431,964, filed May 8, 2003 entitled "home comfort appliance" both of which are hereby incorporated by reference in their entirety.

Referring again to FIG. 1, housing 102 includes one or more sidewalls 105 extending between a bottom 107*b* and a top 107*t* thereby defining an interior space 103. Housing 102 includes an elongated construction, preferably extending vertically upward from the bottom 107*b* to the top 107*t*. This elongate construction of housing 102 results in tower electric heater 101 having a space savings design. Housing 102 also includes one or more air inlet openings 108 and an air outlet opening 104. Protective grill 106 is preferably disposed over air outlet 104 for preventing foreign objects from entering the interior space 103 of housing 102. Disposed within interior space 103 is air blower assembly 110 and electric heating element 116. Portable pedestal electric heater also includes support riser 130 having a base 134 and a riser 132. Pedestal electric heater 100 also includes power cord 140 and control assembly 126. Control assembly 126 controls one or more operations of portable pedestal electric heater 100.

Figure 2:
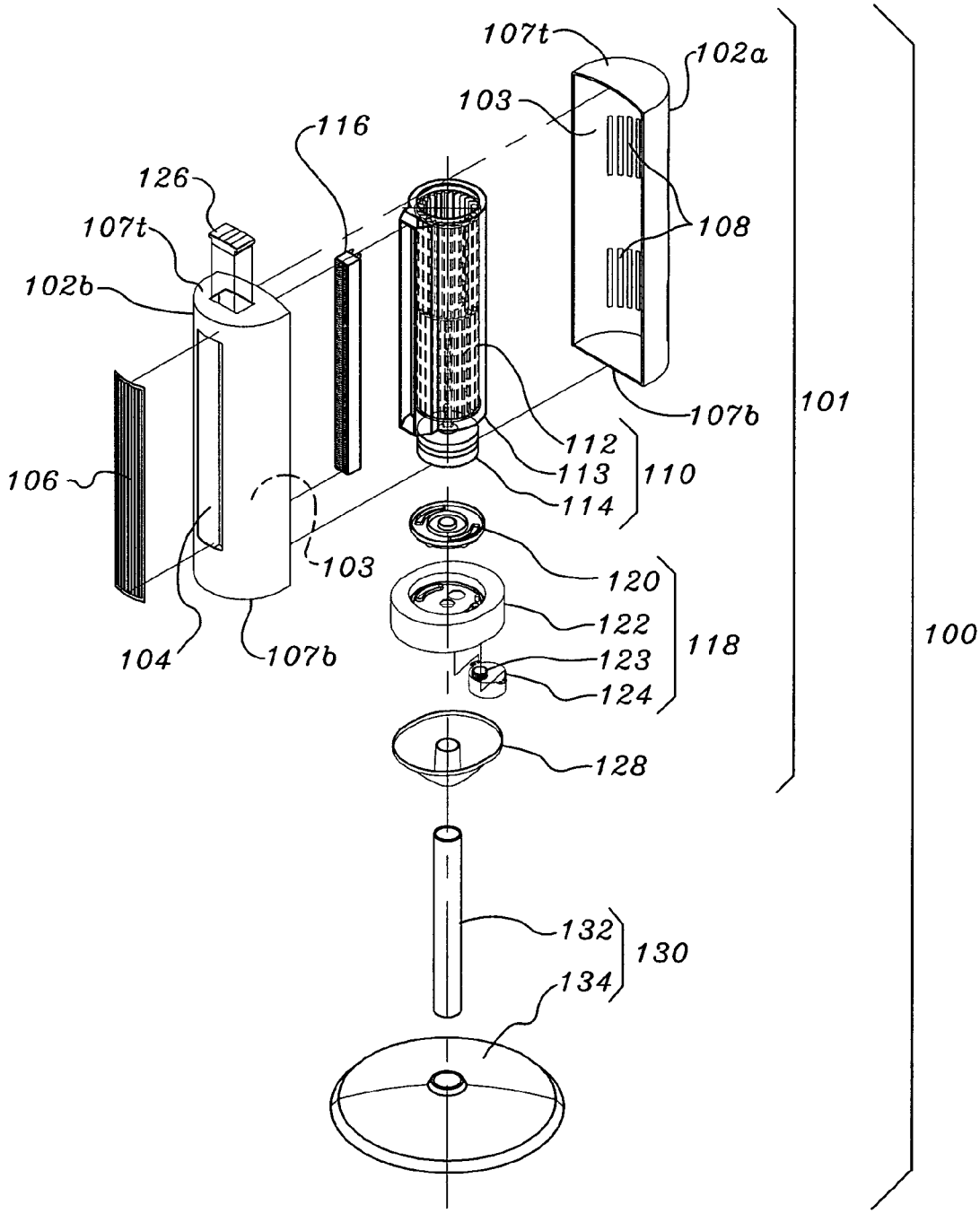
FIG. 2 is an exploded view of the exemplary embodiment of FIG. 1.

FIG. 2 shows an exploded perspective view of portable pedestal electric heater 100. As shown in FIG. 2, housing 102 may be constructed of more than one component, such as, for example, two halves 102*a*, 102*b* that are assembled together. Housing 102 has at least one air inlet opening 108 and an air outlet opening 104. Air outlet opening 104 may be, for example as shown in FIG. 2 elongate and aligned with the longitudinal length of housing 102 of portable pedestal electric heater 100.

Disposed within interior space 103 of housing 102 is at least one air blower assembly 110. Air blower assembly 110 includes at least one motor 114 and at least one air impeller 112 connected to motor 114. Air blower assembly 110 may also include, as in this example, blower housing 113 and other components (not shown). The use of air blower assembly 110 preferably allows for the pre-assembly and pre-testing of air blower assembly 110 thereby allowing the manufacture and assembly of portable pedestal electric heater 100 to be less costly when compared to assembling motor 114, air impeller 112 and blower housing 113 into portable pedestal electric heater 100 as separate components. In one embodiment, air blower assembly 110 is a centrifugal type blower. It is contemplated that other types of blowers or fans may be used, such as for example, transverse type blowers or axial type fan.

Also disposed within interior space 103, proximate air exit opening 104 is heating element 116. Preferably, substantially all of the air being discharged from air blower assembly 110 flows through heating element 116. It is contemplated that a portion of the air being discharged from air blower assembly 110 may bypass heating element 116. Such a bypass may be used to allow safety devices, such as for example a thermal cut off, (not shown) to function properly.

As shown in FIG. 2, in one embodiment heating element 116 includes an elongate electric heating element that is aligned with the longitudinal length of housing 102. In another embodiment, outlet opening 104 also includes an elongate construction and the elongate heating element 116 extends substantially the length of the air outlet opening 104. Use of an elongate electric heating element in conjunction with an elongate outlet opening 104 further allows the heated exhaust air stream to be elevated above a support surface, further facilitating a shorter convection path between the heating element and an upper portion of the user's body. In addition, an elongated construction for heating element 116 and outlet opening 104 also helps the heated exhaust air stream conform to the general shape of the user's upper body.

In one embodiment, heating element 116 uses a Positive Temperature Coefficient (PTC) type heat generation technology. The use of a PTC heating element assures a self-regulating low surface temperature of approximately 450 degrees Fahrenheit [232 degrees Celsius].

The rotation of air impeller 112 causes air to be drawn into housing 102 through air inlet opening(s) 108. The air flow passes through blower assembly 110, passes through heating element 116, and exits housing 102 through air outlet opening 104. As the air flow passed through heating element 116, thermal energy (i.e. heat) is imparted to the air flow.

Preferably, protective grill 106 is located proximate air outlet opening 104. Protective grill 106 is preferably designed to minimize it's impedance of the air flow as it exits portable pedestal electric heater 100 while at the same time protecting portable pedestal electric heater 100 from the internal penetration of foreign objects. Protective grill 106 may include air directing vanes that can be used to control the direction of the heated exhaust air stream as it exits housing 102.

Protective grill 106 may be, for example as shown in FIG. 2 elongate and aligned with the longitudinal length of housing 102 of pedestal electric heater 100. The purpose of the protective grill may include ornamental and/or functional characteristics as described above.

In one exemplary embodiment, an intermediate coupler 128 may be used to couple housing 102 to support column 130. Such a coupler 128 may be either fixed or rotatable. Alternatively, housing 102 may be coupled directly to support column 130 such that housing 102 is fixed with respect to support column 130.

In another exemplary embodiment, housing 102 rotates with respect 20 to support column 130. Such rotation may be accomplished either in an oscillatory fashion (over any angular range that may be desired), a stepwise positioning of housing 102 (either manually or under automated control), or in a constant rotation, either in a clockwise or counter-clockwise direction. As shown, the mechanism for rotation may be located within or below housing 102 and coupled between housing 102 and support riser 130. In yet another embodiment the rotation mechanism may be located between base 134 and riser 132 of support riser 130.

FIG. 2 shows rotation/oscillation mechanism 118. Rotation/oscillation mechanism 118 moves housing 102 of portable pedestal electric heater 100 through rotation and/or oscillation movement. Such movement allows the heated exhaust air stream to be dispersed over a larger coverage area. As shown in FIG. 2, rotation/oscillation mechanism 118 includes a motor 124, gear 123, oscillation plate 120, and oscillation section 122. It is contemplated that other rotating mechanisms, such as a link and pivot design, may be used to achieve rotation/oscillation movement.

As shown, support riser 130 extends from housing 102 and includes riser 132 and base 134. Support riser 130 may be formed of metal, polymer or other materials. Riser 132 maybe comprised of more than one riser member thus allowing for height adjustability (best described with reference to FIG. 5). The upper portion of riser 132 is connected to coupler 128 or housing 102 and the lower portion of riser 132 is connected to base 134.

Base 134 may be comprised of one or multiple pieces attached to one another. Base 134 may be made of materials such as metals or polymers or a combination of various materials. Base 134 sits on a support surface thus allowing the entire structure of portable pedestal electric heater 100 to be positioned in a substantially vertical, upright and elongate position.

Although the exemplary embodiment shown in FIG. 2 illustrates support riser 130 including base 134 and riser 132 as separate pieces, the invention is not so limited. It is contemplated that the support of housing 102 may be accomplished in a variety of ways, such as forming support riser 130 as a unitary member having a variety of predetermined shapes. Other non-limiting examples of such shapes are shown in FIGS. 9 and 10. The vertical space created by support riser 130 between a support surface and the heated exhaust air stream as it exits housing 102 may be used for other functions, such as for example: mounting controls, humidification, air filtration, etc.

Portable pedestal electric heater 100 may also include a controller, such as control assembly 126 mounted, for example, on (or in the vicinity of) top 107*t* of housing 102 for controlling one or more functions of the device, such as for example, the speed of blower assembly 110, the rotation or oscillation of the device, power on/off, heat level, etc. Alternatively, control assembly 126 may be mounted in oscillation section 122, a lower portion of housing 102, on riser 132 or on base 134. Alternatively, control of portable pedestal electric heater 100 may be accomplished by a remote control unit (not shown) in conjunction with or as a replacement for control assembly 126.

The position of the control assembly 126 on top 107*t* of housing 102 on the substantially vertical, upright and elongate structure of portable pedestal electric heater 100 also benefits the user in that the height of the controller above a support surface (floor) allows convenient accessibility for visual inspection and manually adjustment of the controller.

Referring again to FIG. 1, the exemplary embodiment illustrates one method of routing power cord 140 from an electrical connection (not shown) in portable pedestal electric heater 100 through riser 132 and exiting base 134 at a lower portion of portable pedestal electric heater 100. The routing of power cord 140 through riser 132 prevents power cord 140 from becoming entangled in other components of portable pedestal electric heater 100 during oscillation. Alternatively, power cord 140 may exit through an opening in housing 102.

Figure 3A:
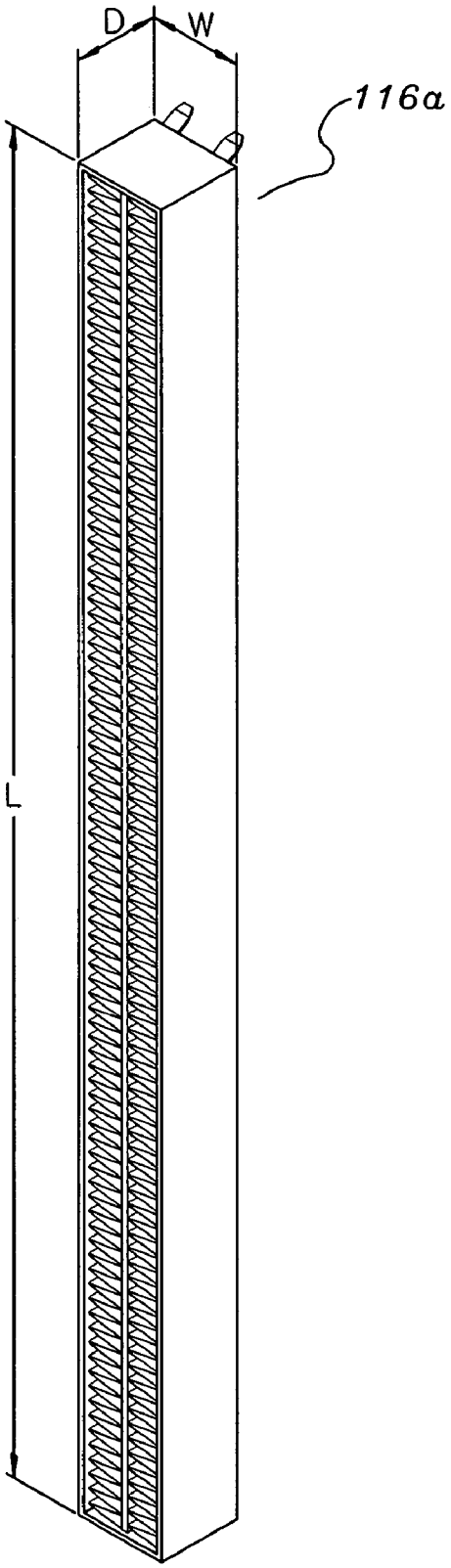
FIGS. 3A and 3B illustrate the dimensional aspects of exemplary heating elements.
Figure 3B:
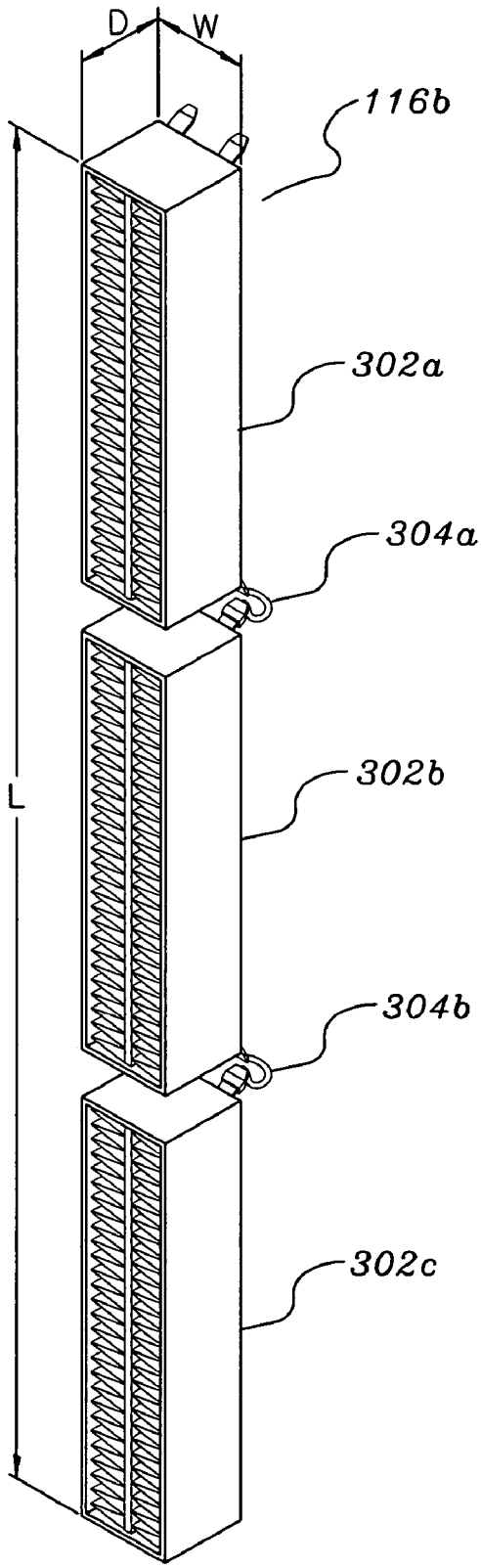

FIGS. 3A and 3B show exemplary embodiments of elongate heating element 116*a* and 116*b*. The heat generation method can be, for example, Positive Temperature Coefficient (PTC) heat generation technology. As shown in FIG. 3A, elongate heating element 116*a* is shown having a predetermined length "L", in a vertical orientation, a predetermined width "W" and a predetermined depth "D". The ratio of length "L" to width "W" is preferably greater than about 2:1. In one embodiment, the preferred predetermined length "L" of elongate heating element 116*a* is about 8 inches or greater. In yet another embodiment, the predetermined length "L" of elongate heating element 116*a* is about 5 inches or greater. The use of a single elongate heating element minimizes the number of connections and simplifies the design and assembly of the heating element 116.

FIG. 3B shows another exemplary embodiment of elongate heating element 116*b*. As shown in FIG. 3B, elongate heating element 116*b* may be constructed of one or more segments 302*a*, 302*b*, 302*c*. As shown, segments 302*a*, 302*b* and 302*c* are preferably arranged substantially contiguous and aligned end to end. The use of multiple segments 302*a*, 302*b*, 302*c* may require additional connections 304*a* and 304*b* between segments.

The use of a PTC elongate heating element, for example, requires that the length "L" to width "W" aspect ratio be designed to achieve the proper watt density and flow through characteristics. In general, as length "L" increases, the watt-density decreases, and cost increases for the same width heating element. For example, the use of a 1500 watt PTC elongate heating element limits length "L" of elongate heating element 116*a* or 116*b*, in that the watt density within the heating element will not heat the surfaces of heating element 116*a* or 116*b* efficiently if length "L" is too long. This inefficient heating will in turn create inefficient heating of the exhaust air stream. This design limitation on the length of the elongate heating element limits the elevation height of a conventional tower heater above a support surface (e.g., floor).

The use of a support riser 130 in pedestal electric heater 100 of the present invention is utilized to overcome this heating element design limitation (as well as other design consideration, as discussed below). Support riser 130 allows length "L" of elongate heating element 116*a* or 116*b* to be of a length so as to maintain the desired watt density while at the same time achieving the desired elevation of the heated exhaust air stream above a support surface. (see FIGS. 4A and 4B). It is preferred to maintain watt-density as high as possible because as watt-density increases the temperature of the heated exhaust air stream also increases (assuming a constant velocity through the heating element). In addition to improving the watt-density of the heating element, keeping the length "L" shorter also reduces the complexity and cost of the heating element 116. The use of support riser 130 to further elevate the heating element, and thus the heated exhaust air stream allows for the use of a shorter length "L" that might otherwise be possible to achieve the desired shortened flow path between the heating element and an upper portion of the user. This results in more cost efficient heating.

Figure 4B:
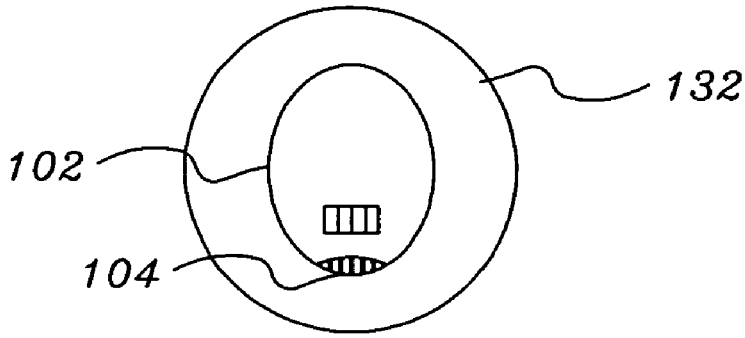
FIGS. 4A and 4B are front and top views, respectively, of an exemplary embodiment of the portable pedestal electric heater illustrating various dimensional relationships of the cooperating elements.
Figure 4A:
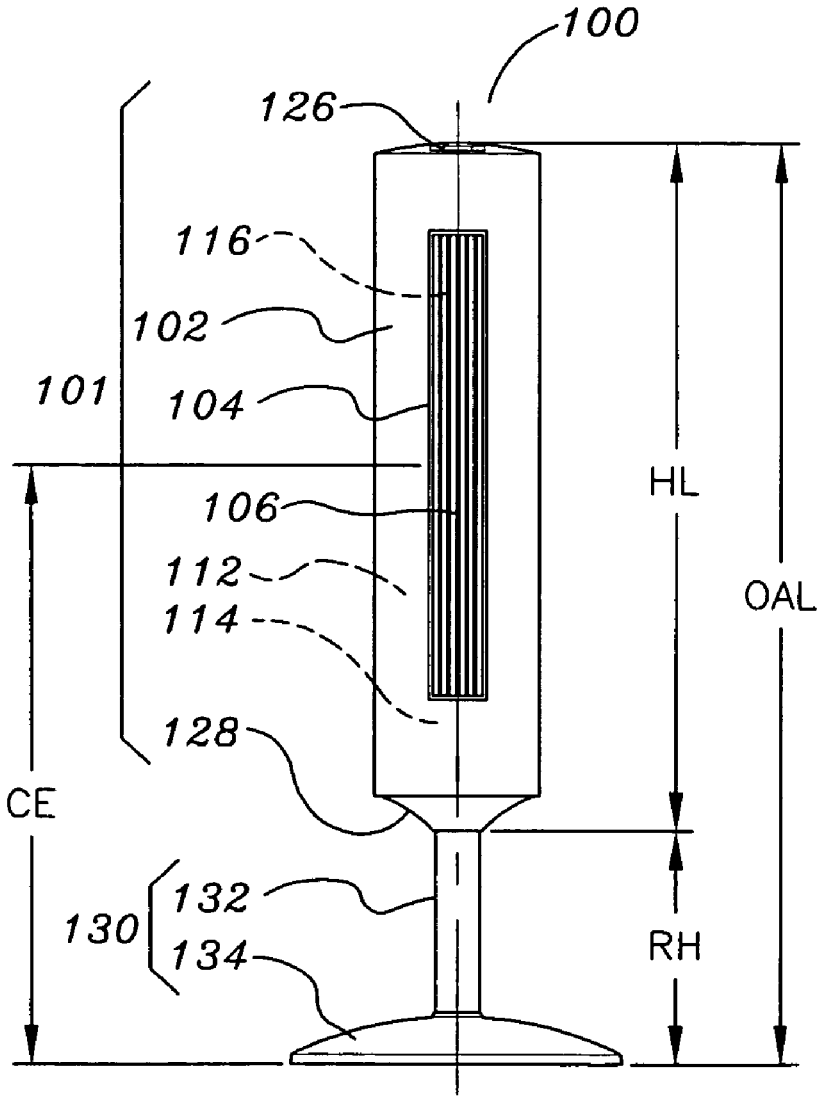

FIGS. 4A and 4B show various dimensional relationships of portable pedestal electric heater 100. As shown, dimension HL is the length or height of housing 102 and dimension RH is the length or height of support riser 130, which in this example is the combined length or height of base 134 and riser 132. Dimension OAL is defined by the length or height of portable pedestal electric heater 100 as measured from the bottom of support riser 130 to top of housing 102. Dimension CE is defined by the distance from the vertical center of air outlet opening 104 to a surface of support riser 130 which contacts a support surface.

The use of elongate housing 102 of tower electric heater 101 in conjunction with support riser 130 provides flexibility in the design and selection of different components of the device, such as the characteristics and type of air blower assembly 110 or heating element 116, and also allows the dimensions of elongate housing 102 and support riser 130 to be manipulated to obtain the desired height for optimizing the delivery of the heated exhaust air stream above a support surface. For example, increasing the length or height RH of the support riser 130 allows housing 102 to have a smaller length or height HL, thereby simplifying the design and manufacturing of air blower assembly 110 and heating element 116. This can save both materials and manufacturing complexity which in turn lowers the cost to the end user.

In one embodiment rise height RH is greater than about 25% of dimension CE. In addition, in another embodiment rise height RH is greater than about 15% of overall length OAL of portable pedestal electric heater 100. In yet another embodiment, rise height RH is greater than about 16% of length HL of housing 102. In another embodiment, length HL of housing 102 is less than about 85% of overall length OAL In one embodiment dimension CE is greater than about 65% of overall length OAL. In yet another embodiment dimension CE is greater than about 70% of length HL.

In one exemplary embodiment dimension CE is preferably about 14 inches or greater. In another exemplary embodiment, rise height RH is at least about 3.5 inches or greater and may be adjustable as desired. Further, length HL of housing 102 may preferably be between about 14 inches and about 50 inches, while the overall length OAL from the floor to the top of portable pedestal electric heater 100 is preferably about 18 inches or greater, and alternatively between about 18 inches to about 60 inches.

The above dimensional relationships of portable pedestal electric heater 100 allow for elevating the heated exhaust air stream, thus shortening the heat path and promoting the desired effect on the user. These proportional relationships also provide that the length of air impeller 112 will be of a dimension allowing cost effective manufacturing, while yet providing portable pedestal electric heater 100 with the desired vertical elongate aspect ratio. The length of air impeller 112 would also require less power to rotate than a longer air impeller, thus allowing motor 114 to use less materials and be more cost effective. These proportional relationships also provide that heating element 116 will have the desired watt density to efficiently heat the exhaust air stream while yet providing the desired vertical elongate aspect ratio and space saving characteristics, best described with respect to FIG. 5.

Figure 5:
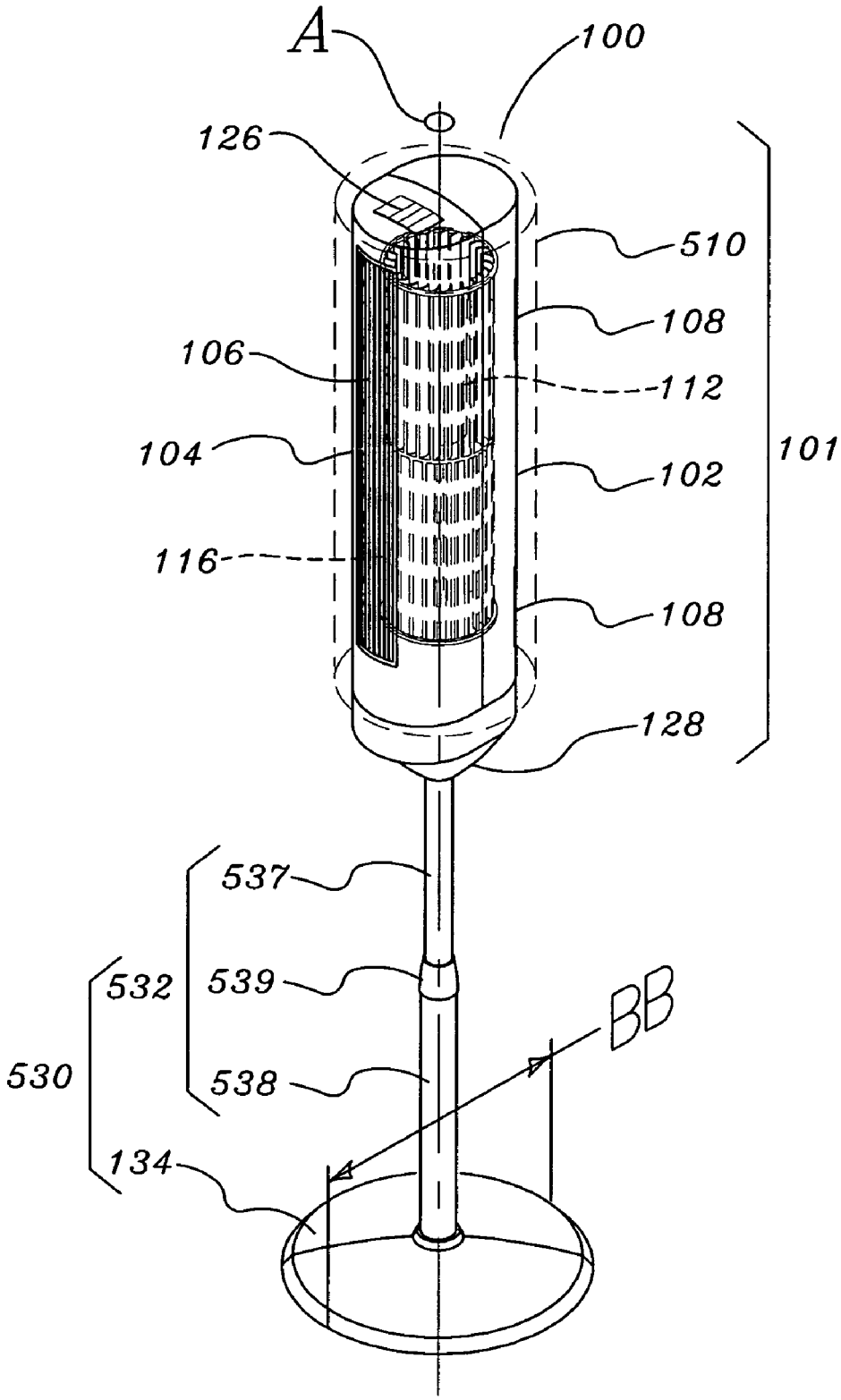
FIG. 5 is a perspective view of another exemplary embodiment of the portable pedestal electric heater with an adjustable height feature.

FIG. 5 shows an exemplary embodiment of the portable pedestal electric heater 100 having an adjustable support column 532. As shown, adjustable support column 532 includes a plurality of cooperating columns 537, 538. In the embodiment shown, the cooperating columns include upper column 537 slideably connected to lower column 538 with adjustable coupler 539 there between. In the lower most position, upper column 537 fits substantially within lower column 538. Adjustable coupler 539 allows movement of the columns with respect to one another to adjust the height of support riser 130 and also allows for fixing the columns with respect to one another to set the height of support riser 130. In this example the overall height of portable pedestal electric heater 100 can be adjusted to allow the user more flexibility regarding the elevation of the heated exhaust air stream above floor level. Additional columns and couplers (not shown) may be used as required.

FIG. 5 also illustrates that the rotational axis of oscillation of housing 102 is preferably substantially co-linear with central axis "A" of portable pedestal electric heater 100. The vertical aspect ratio of housing 102 allows oscillation envelope 510 to be distributed along central axis "A". Oscillation envelope 510 is defined as the area of movement of housing 102 about the rotational axis of oscillation. The axis of rotation of air impeller 112 of air blower assembly 110 within interior space 103 of housing 102 is preferably oriented vertically and substantially co-linear with central axis "A" of portable pedestal electric heater 100. This reduces the effects of gyroscopic precession during the oscillation of housing 102 and increases the stability of portable pedestal electric heater 100.

In one exemplary embodiment oscillation envelope 510 is substantially equal to a maximum width of a horizontal cross-sectional area of housing 102. In another exemplary embodiment the maximum width of a horizontal cross-sectional area of housing 102 is about 12 inches or less. In yet another embodiment the ratio of the length dimension HL of housing 102 to a maximum width of a horizontal cross-sectional area of housing 102 is less than about 1.5:1.

In one exemplary embodiment air impeller 112 has a predetermined diameter and a predetermined length to allow air impeller 112 to have an elongated aspect ratio. In one embodiment the predetermined length to the predetermined diameter aspect ratio of impeller 112 is greater than about 2:1. Maintaining the elongated aspect ratio of air impeller 112 allows it to fit within elongate housing 102 of pedestal electric heater 100.

In one embodiment air impeller 112 is a limited volume impeller. For example, the velocity of the heated exhaust air stream is preferably fixed to effectively reach the user. The desired temperature of the heated exhaust air stream is also preferably fixed to deliver an adequate temperature differential between the ambient air temperature and the temperature of the heated exhaust air stream. Elongate heating element 116 may be for example a PTC heating element with a fixed maximum wattage of 1500W. This fixed wattage requirement along with the fixed temperature and velocity requirements of the heated exhaust air stream determines a fixed watt density requirement of elongate heating element 116. The fixed watt density requirement of elongate heating element 116 is achieved by the proper ratio of length "L" to width "W" of elongate heating element 116. Thus the area of elongate heating element 116 is preferably fixed to have the desired watt density to sufficiently heat the heated exhaust air stream to the desired temperature. Air flow through the heating element may be stated:

$$Q/A=V$$

Where: Q is the volume, (cubic feet per minute) of air flowing through elongate heating element 116, A is the area of elongate heating element 116 and V is the desired velocity of the heated exhaust air stream. The volume of air Q is preferably sufficiently limited for the desired velocity V to be achieved while not exceeding the 1500 watt output desired for elongate heating element 116.

An effective way to limit volume Q of impeller 112 is to reduce its diameter. The limited diameter of impeller 112 also more easily fits within elongate housing 102 of pedestal electric heater 100, thus maintaining the desired vertical aspect ratio.

The vertical aspect ratio of housing 102, allows the oscillating components of portable pedestal electric heater 100 to be substantially on center with support riser 530 along central axis "A" thus increasing the stability of portable pedestal electric heater 100.

The substantially vertical, upright and elongate structure of portable pedestal electric heater 100, (which includes the vertical aspect ratio of housing 102 and preferably includes an elongate heating element 116) helps to minimizes the vertical distance above a support surface, (floor) to the center of gravity of portable pedestal electric heater 100. This structure, along with substantially centering the oscillating components on support riser 530 along central axis "A", coupled with the reduced effects of gyroscopic precession during oscillation, increase the stability of portable pedestal electric heater 100. This increased stability allows dimension BB of base 134 to be minimized. The minimized dimension BB of base 134 allows portable pedestal electric heater 100 to have further space saving characteristics and, to be easily transported from place to place within a living space or between various living spaces as desired. The minimized dimension BB of base 134 also allows an economization of the size of a shipping package for portable pedestal electric heater 100. The economization of the size of a shipping package allows more units to be shipped in a container, (i.e. truck) and thereby reduces the overall cost per unit of transportation, (see FIGS. 8A, 8B and 8C).

Dimension BB of base 134 is equal to the maximum width of a horizontal cross-sectional area of base 134. In another exemplary embodiment dimension BB of base 134 is about 18 inches or less for a portable pedestal electric heater 100 having housing 102 with a maximum width of a horizontal cross-sectional area of about 12 inches or less. In yet another exemplary embodiment the maximum width of a horizontal cross-sectional area of housing 102 is less than about 70% of dimension BB.

Figure 6:
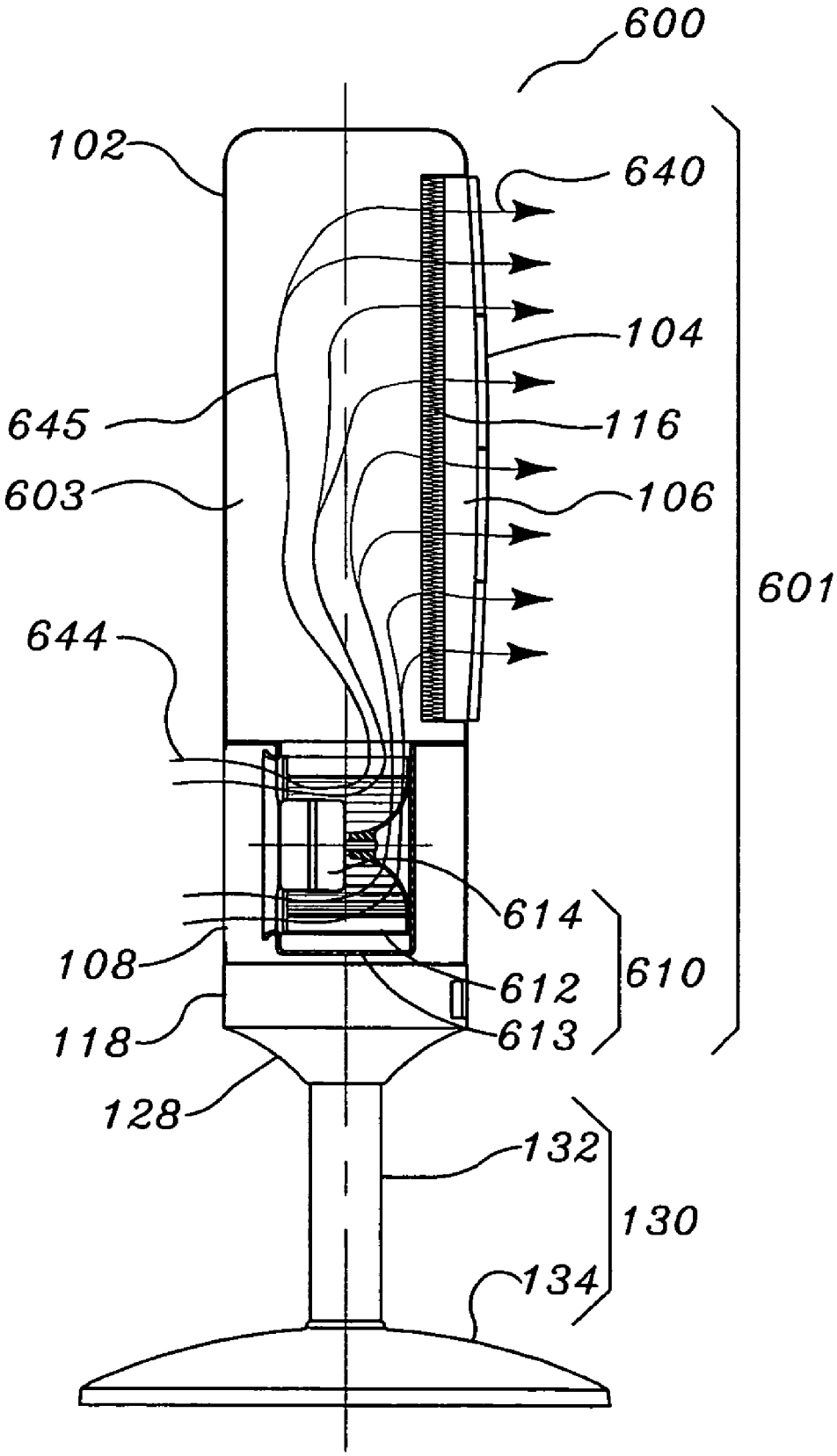
FIG. 6 is a partial section showing another exemplary embodiment of the portable pedestal electric heater of the present invention.

FIG. 6 shows another exemplary embodiment of the portable pedestal electric heater. FIG. 6 illustrates a partial cross sectional side view through portable pedestal electric heater 600. Portable pedestal electric heater 600 is comprised of housing 102 defining interior space 603. Within interior space 603 is disposed heating element 116 and blower assembly 610. Blower assembly 610, in this example, includes motor 614, air impeller 612 and blower housing 613. In this example, air impeller 612 is a centrifugal blower type impeller.

Air 644 is drawn into blower assembly 610 through at least one inlet opening 108 in housing 102. Exhaust air 645 is discharged from blower assembly 610 into interior space 603 of housing 102. Exhaust air 645 then passes through elongate heating element 116 and is discharged from portable pedestal electric heater 600 as heated exhaust air stream 640. Heating element 116 is located proximate air exit opening 104. Also located proximate air exit opening 104 is protective grill 106.

The location of blower assembly 610 in the lower portion of housing 102 lowers the center of gravity of portable pedestal electric heater 600 in that the weight of motor 614, impeller 612 and blower housing 613 are low with respect to the bottom of support riser 130. This increases the stability of portable pedestal electric heater 600 and allows for the desired vertical elongate aspect ratio, increased height of the heated exhaust air stream, and space saving characteristics.

Figure 7A:
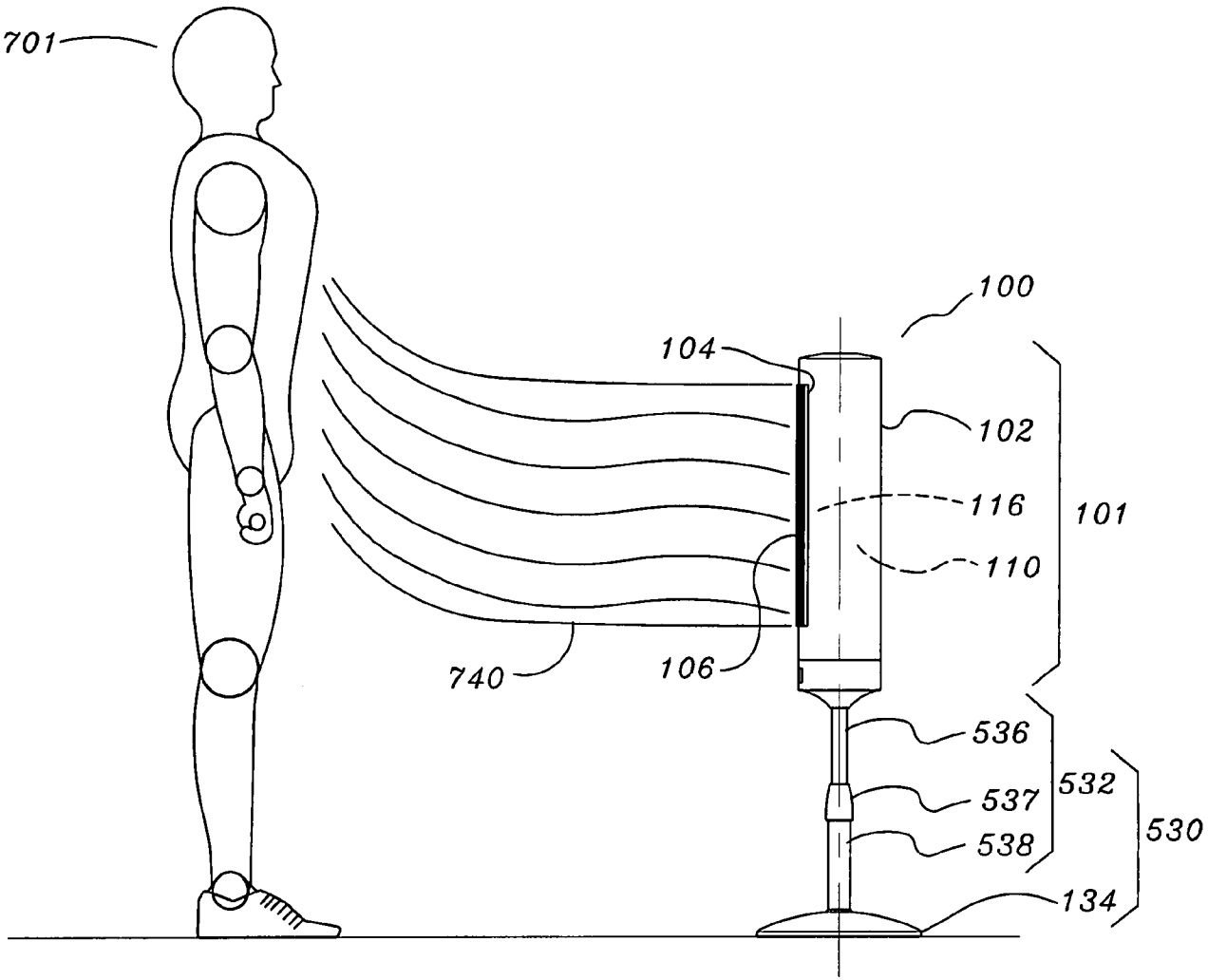
FIGS. 7A and 7B illustrate the elevated heated exhaust air stream of a portable pedestal electric heater according to the present invention compared to a conventional heater.
Figure 7B:
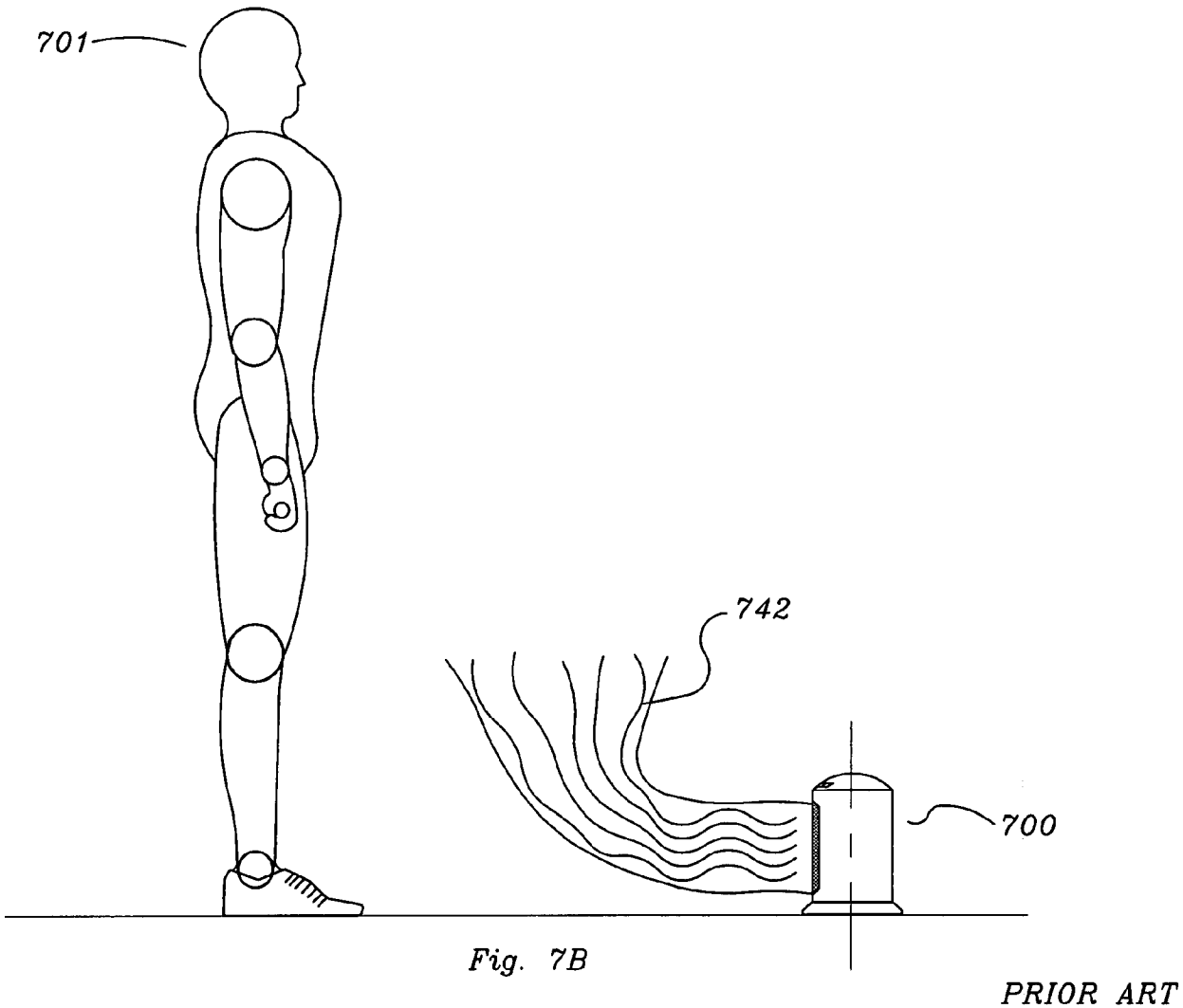
PRIOR ART Fig. 7B

FIGS. 7A and 7B illustrate the advantages of the pedestal electric heater of the present invention when compared to a standard portable electric heater design. FIG. 7A shows an exemplary embodiment of the present invention and FIG. 7B illustrates standard portable electric heater 700. As shown in FIG. 7B, heated exhaust air stream 742 exits standard portable electric heater 700 at a low elevation. This low elevation increases the distance that the heat must traverse to reach an upper portion of user 701.

In contrast, FIG. 7A illustrates the improved performance characteristics of portable pedestal electric heater 100 in accordance with the present invention. Heated exhaust air steam 740 exits portable pedestal electric heater 100 at an elevation that shortens the distance that must be traversed by heated exhaust air stream 740 in order to effect an upper potion of user 701. The upper portion of user 701 is normally more exposed and therefore will experience the effects of heated exhaust air stream 740 more readily, contributing to the more immediate relief of user 701.

The substantially vertical, upright and elongate structure of portable pedestal electric heater 100 also benefits user 701 in that the shape of heated exhaust air stream 740 may be elongate and vertical as it exits housing 102. An elongate and vertical shape of heated exhaust air stream 740 generally conforms to the human body.

Figure 8A:
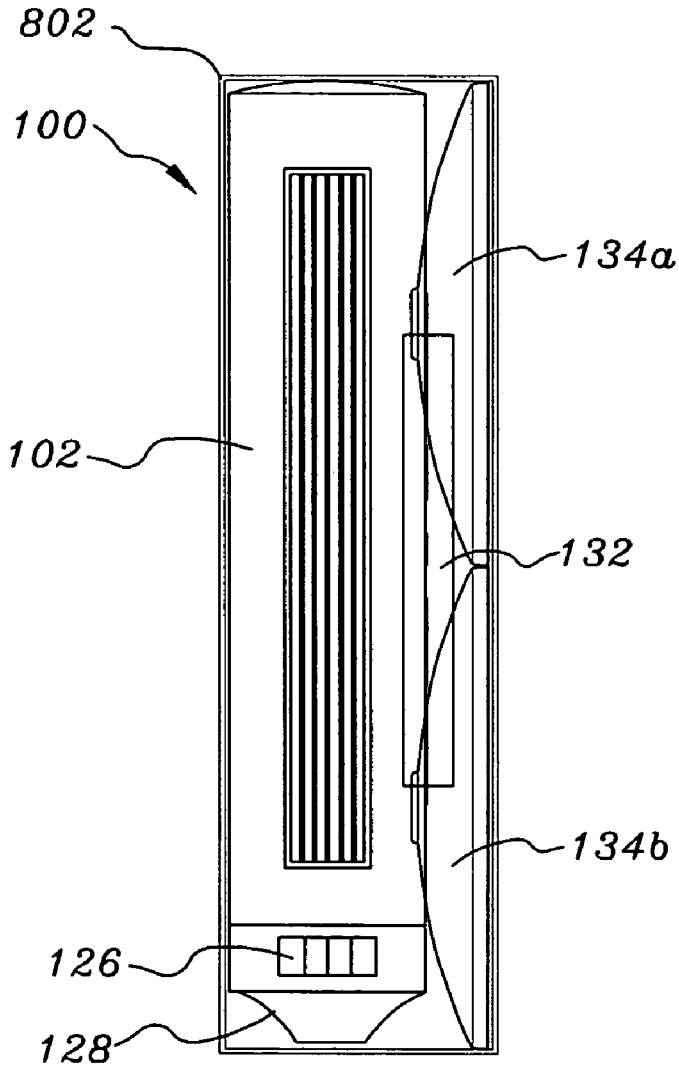
FIGS. 8A, 8B, 8C and 8D are views of exemplary packaging according the present invention.
Figure 8B:
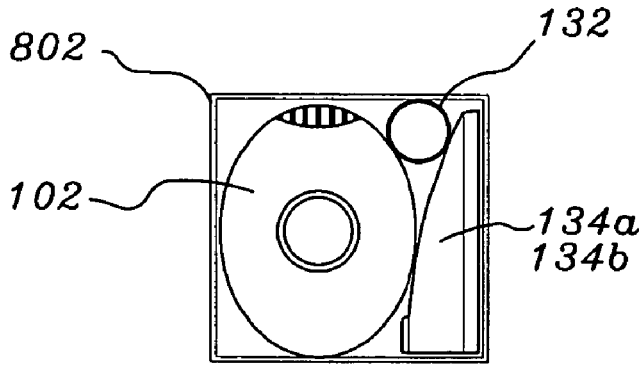

FIGS. 8A, 8B, 8C, and 8D illustrate another advantage realized with respect to packaging and shipment of the exemplary design of the portable pedestal electric heater 100 of the present invention. As shown in FIGS. 8A and 8B, portable pedestal electric heater 100 is packaged in a non-operating configuration, wherein housing 102 is separated from riser 132 and base 134. In this example base 134 is designed to be separate from riser 132 and further disassemble into one or more portions, such as portions 134*a* and 134*b*. Shipping box 802 is therefore able to economize the space necessary to transport portable pedestal electric heater 100, thus using less packaging materials and lowering the cost of the packaging.

Figures 8C, 8D:
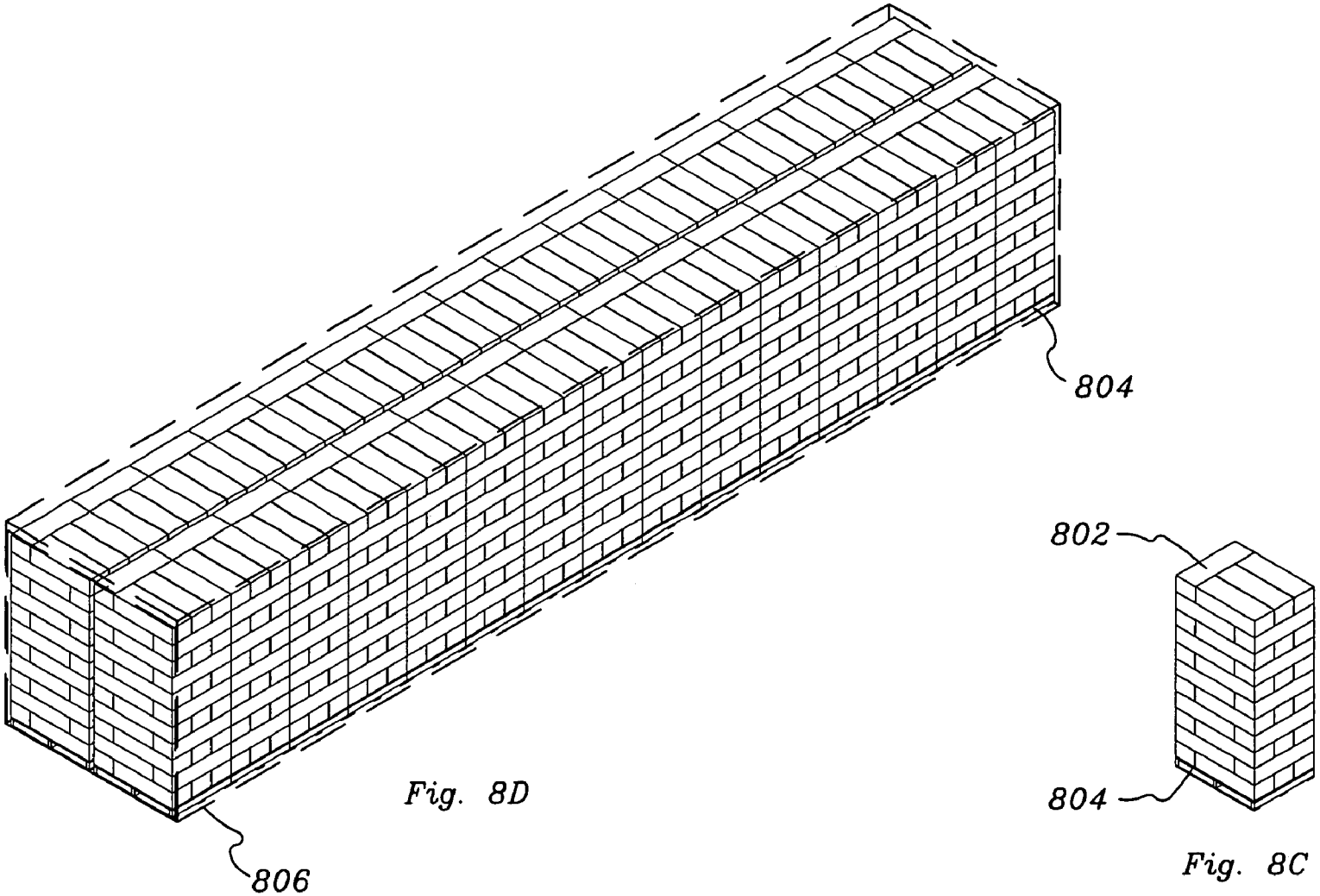

As shown in FIGS. 8C and 8D, because of the economized space for shipping box 802, packaging of the portable pedestal electric heater 100 of the present invention on pallet 804 and in container 806 is also economized. Furthermore, the number of units capable of transportation in shipping container 806 as shown in FIG. 8D is maximized. These shipping advantages yield a lower cost of transportation and a cost advantage for the manufacturer and the consumer.

Figure 9B:
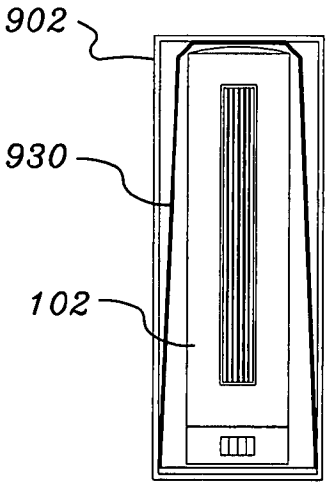
FIGS. 9A, 9B and 9C are views of yet another exemplary embodiment of the present invention and illustrates exemplary packaging of that embodiment.
Figure 9C:
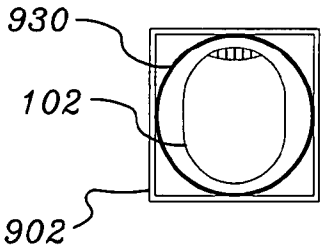
Figure 9A:
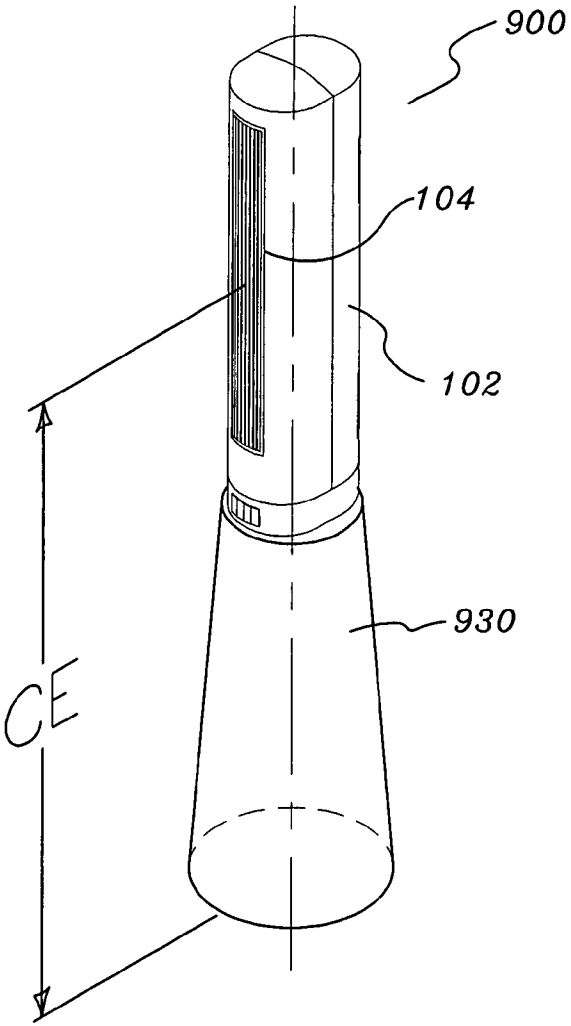

FIG. 9A shows yet another exemplary embodiment of portable pedestal electric heater 900 with support riser 930. Support riser 930 can be a unitary part or constructed of more than one piece assembled together. Support riser 930 achieves the designed dimension CE as defined by the distance from the vertical center of outlet opening 104 to the bottom of support riser 930 and the stability that support riser 130, (comprised of riser 132 and base 134) achieved in previously described embodiments. FIGS. 9B and 9C illustrate the packaging of portable pedestal electric heater 900 in a non-operating configuration, wherein housing 102 is separated from support riser 930. In this example housing 102 has the ability to fit within support riser 930. Shipping box 902 is therefore able to economize the space necessary to transport portable pedestal electric heater 900, thus using less packaging materials and lowering the cost of the packaging.

Figure 10B:
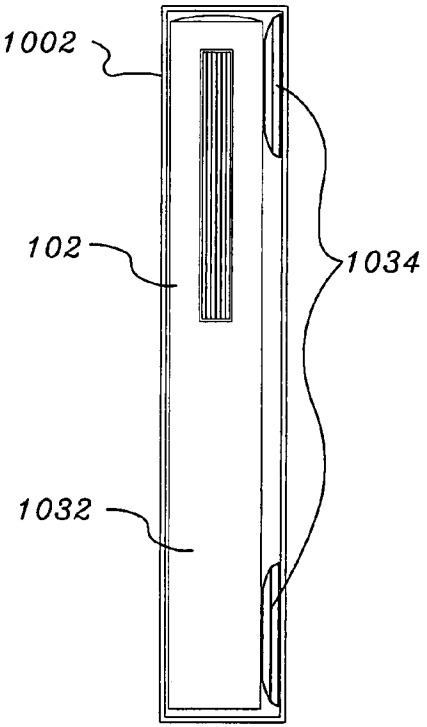
FIGS. 10A, 10B and 10C are views of yet another exemplary embodiment of the present invention and illustrates exemplary packaging of that embodiment.
Figure 10C:
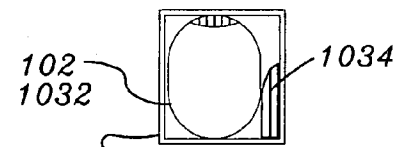
Figure 10A:
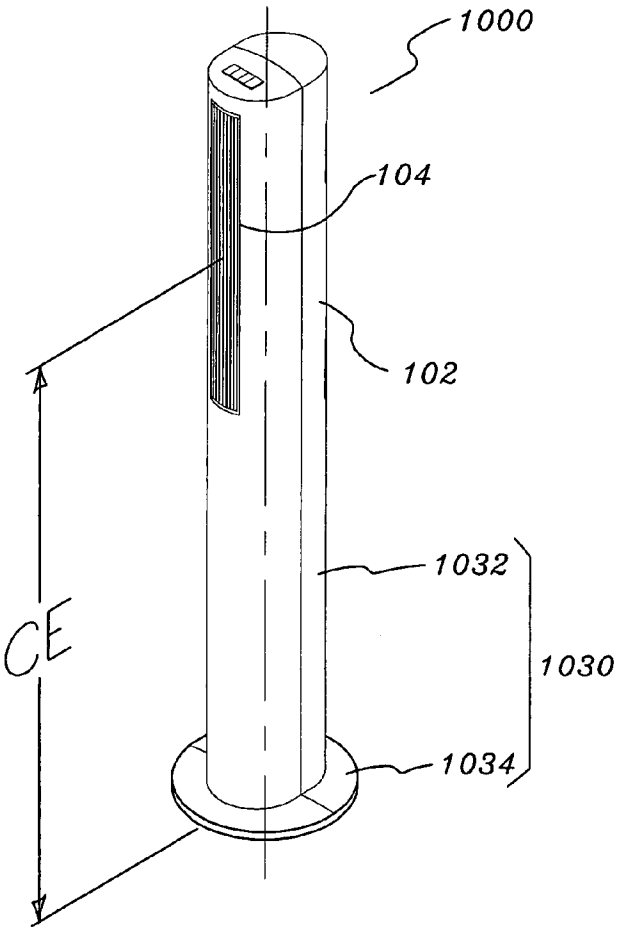

FIG. 10A shows yet another exemplary embodiment of portable pedestal electric heater 1000 with support riser 1030. Support riser 1030 in this example is comprised of support column 1032 and base 1034. Support column 1032 may be a unitary part of housing 102 or a separate part assembled to housing 102. Support riser 1030 achieves the designed dimension CE as defined by the distance from the vertical center of outlet opening 104 to the bottom of support riser 1030 and the stability that support riser 130, (comprised of riser 132 and base 134) achieved in previously described embodiments. FIGS. 10B and 10C illustrate the packaging of portable pedestal electric heater 1000 in a non-operating configuration, wherein base 1034 is separated from support column 1032. In this example housing 102 and support column 1032 are shipped to a customer as a unitary part or assembled together. Although shipping box 1002 does not economize space as well as previous examples, it does require less assembly for the end user.

Although the invention has been described with reference to exemplary embodiments, it is not limited thereto. Rather, the appended claims should be construed to include other variants and embodiments of the invention, which may be made by those skilled in the art without departing from the true spirit and scope of the present invention.

What is claimed:

1. A portable pedestal electric heater apparatus for providing a heated exhaust air stream at an elevation above a support surface, said apparatus comprising:

a tower electric heater comprising:

i) an elongate housing having at least one sidewall, a top end, a bottom end, and a longitudinal length extending substantially upward from said bottom end to said top end;

ii) at least one interior space within said elongate housing;

iii) at least one inlet opening in said elongate housing allowing inlet air to enter said at least one interior space;

iv) an air blower assembly disposed within said at least one interior space for receiving said inlet air, said air blower assembly comprising:

(i) at least one air impeller;

(ii) at least one motor for rotating said air impeller to generate an exhaust air stream;

v) a substantially continuous and vertically oriented air outlet opening in said elongate housing;

vi) a vertically oriented electric heating element disposed within said at least one interior space between said air blower assembly and said air outlet opening such that thermal energy is transferred from said electric heating element to substantially all of said exhaust air stream as said exhaust air stream;

vii) an assembled alignment of said air impeller, said electric heating element and said air outlet opening, wherein said assembled alignment facilitates a substantially straight vector flow of said air stream through said electric heating element and said air outlet opening;

viii) a heated exhaust air stream projected from said interior space of said elongate housing via said substantially continuous and vertically oriented air outlet opening, wherein said heated exhaust air stream forms a substantially continuous, vertically oriented, elongate column of heated exhaust air;

a support riser for supporting said tower electric heater at an elevation above a support surface, said support riser comprising:

i) a base in contact with said support surface;

ii) riser having a longitudinal length extending substantially upward from said base, said riser comprising:

a) a first end and connected to said base;

b) a second end connected to said elongate housing; and an elevation of said heated exhaust air stream defined by a distance from where said support riser contacts said support surface to a vertical midpoint of said substantially continuous and vertically oriented air outlet opening of said tower electric heater, and said elevation of said heated exhaust air stream is about 14 inches or greater;

wherein said heated exhaust air stream, having said substantially continuous, vertically oriented, elongate columnar shape, conforms to the shape of the human form, and wherein said support riser facilitates said elevation of said heated exhaust air stream, thereby more efficiently heating an upper portion of said human form.

2. The portable pedestal electric heater apparatus of claim 1, wherein said air blower assembly further comprises a centrifugal blower assembly.

3. The portable pedestal electric heater apparatus of claim 1, wherein said air blower assembly further comprises a transverse blower assembly.

4. The portable pedestal electric heater apparatus of claim 1, wherein said air blower assembly further comprises an axial fan type blower assembly.

5. The portable pedestal electric heater apparatus of claim 1, wherein said at least one air impeller further comprises a length and a diameter, and a ratio of said length to said diameter is greater than about 2:1.

6. The portable pedestal electric heater apparatus of claim 1, further comprising a controller for controlling a function of said portable pedestal electric heater.

7. The portable pedestal electric heater apparatus of claim 6, wherein said controller is mounted to one of said elongate housing and said support riser.

8. The portable pedestal electric heater apparatus of claim 6, wherein said controller comprises a remote device.

9. The portable pedestal electric heater apparatus of claim 6, wherein said motor further comprises a variable speed motor having one or more rotational speeds, and said controller controls said rotational speeds.

10. The portable pedestal electric heater apparatus of claim 1, wherein said elongate housing rotates or oscillates relative to said support surface, and said rotation or oscillation is about an axis of rotation, said axis of rotation being substantially aligned with a vertical longitudinal axis of said support riser.

11. The portable pedestal electric heater apparatus of claim 10, further comprisina an axis of rotation of said at least one air impeller wherein said axis of rotation of said elongate housing is substantially parallel to said axis of rotation of said at least one air impeller.

12. The portable pedestal electric heater apparatus of claim 10, wherein said at least one air impeller further comprises and axial length greater than about 50% of said longitudinal length of said housing.

13. The portable pedestal electric heater apparatus of claim 10, further comprising a mechanism for rotating or oscillating said elongate housing relative to said support surface.

14. The portable pedestal electric heater apparatus of claim 13, wherein said mechanism is disposed between one of i) said first end of said riser and said base, or ii) said second end of said riser and said elongate housing.

15. The portable pedestal electric heater apparatus of claim 13, further comprising a controller for controlling a function of said mechanism for rotating or oscillating said elongate housing.

16. The portable pedestal electric heater apparatus of claim 1, further comprising a grill covering said vertically oriented air outlet opening.

17. The portable pedestal electric heater apparatus of claim 16, wherein said grill further comprises air directing vanes that can be positioned to direct said exhaust air stream exiting said housing to a desired location.

18. The portable pedestal electric heater apparatus of claim 1, wherein an overall length of said portable pedestal electric heater is defined by the distance from where said support nser contacts said support surface and said top end of said elongate housing.

19. The portable pedestal electric heater apparatus of claim 18, wherein said elevation of said heated exhaust air stream is greater than about 65% of said overall length.

20. The portable pedestal electric heater apparatus of claim 18, further comprising a rise height defined by a distance from where said base contacts said support surface to said second end of said riser, wherein said rise height is greater than about 15% of said overall length.

21. The portable pedestal electric heater apparatus of claim 18, wherein said longitudinal length of said elongate housing is less than about 85% of said overall length.

22. The portable pedestal electric heater apparatus of claim 1, wherein said elevation of said heated exhaust air stream is greater than about 70% of said longitudinal length of said elongate housing.

23. The portable pedestal electric heater apparatus of claim 1, further comprising a rise height defined by a distance from where said base contacts said support surface to said second end of said riser, wherein said rise height is greater than about 25% of said elevation of said heated exhaust air stream.

24. The portable pedestal electric heater apparatus of claim 1, further comprising a rise height defined by a distance from where said base contacts said support surface to said second end of said riser, wherein said rise height is greater than about 16% of said longitudinal length of said elongate housing.

25. The portable pedestal electric heater apparatus of claim 1, further comprising a rise height defined by a distance from where said base contacts said support surface to said second end of said riser, wherein said rise height is about 3.5 inches or greater.

26. The portable pedestal electric heater apparatus of claim 1, further comprising a rise height defined by a distance from where said base contacts said support surface to said second end of said riser, wherein said support riser is adjustable with respect to said rise height.

27. The portable pedestal electric heater apparatus of claim 1, wherein said electric heating element further comprises a vertical aspect ratio greater than about 2:1 defined by a length of said elongate electric heating element being greater than a width of said elongate electric heating element.

28. The portable pedestal electric heater apparatus of claim 27, wherein said elongate electric heating element has a length of about 5 inches or greater.

29. The portable pedestal electric heater apparatus of claim 27, wherein said elongate electric heating element preferably has a length of about 8 inches or greater.

30. The portable pedestal electric heater apparatus of claim 27, wherein said elongate electric heating element is a positive temperature coefficient (PTC) heating element capable of producing about 150 watts of energy.

31. The portable pedestal electric heater apparatus of claim 27, wherein said heated exhaust air stream has a flow pattern that substantially conforms to said vertical aspect ratio of said elongate electric heating element.

32. The portable pedestal electric heater apparatus of claim 1, further comprising a power cord, wherein said power cord is routed through a central portion of said support riser and exits at a lower portion of said support riser.

33. The portable pedestal electric heater apparatus of claim 1, wherein said heated exhaust air stream further uses natural convection in combination with said support riser to efficiently heating an upper portion of said human form.

34. The portable pedestal electric heater apparatus of claim 1, further comprising an axis of rotation about which said elongate housing rotates or oscillates and a longitudinal center axis of said support riser, wherein said axis of rotation and said longitudinal center axis are substantially aligned.

35. A portable pedestal electric heater apparatus, comprising:

an operating position, in which said portable pedestal electric heater is assembled and ready for operation;

a non-operating position, in which the portable pedestal electric heater apparatus is disassembled and packaged for shipment;

in said operating position, said portable pedestal electric heater apparatus comprises:

a support riser comprising:

i) a base engaging a support surface; and ii) a riser having a longitudinal length extending substantially upward from said base to a second end said riser absent an electric heating element;

a vertically oriented space saving tower electric heater mounted on top of said support riser, said vertically oriented space saving tower electric heater comprising:

i) an elongate housing coupled to said second end of said riser, said elongate housing having a longitudinal length extending substantially vertically upward from a bottom to a top of said elongate housing;

ii) an air inlet in said housing;

iii) an air outlet opening in said housing;

iv) an air blower assembly disposed within said housing, said air blower assembly having an air impeller and a motor for rotating said air impeller, wherein rotation of said air blower assembly draws inlet air into said housing through said air inlet and discharges exhaust air from said housing through said air outlet; and v) an eleftgate-electric heating element disposed within said housing between said air blower assembly and said air outlet opening, wherein i-substantially all of said exhaust air being discharged by said air blower assembly is heated as said air flows through said electric heating element;

wherein said electric heating element and said air outlet opening are positioned such that a vertical midpoint of heated exhaust air exiting said air outlet opening is about 14 inches or greater above said support surface; and in said non-operating position, said portable pedestal electric heater apparatus comprises;

a shipping box;

said riser disconnected from said base; and a disposition of said vertically oriented space saving tower electric heater, said base and said riser within said shipping box;

wherein said non-operating position facilitates efficient transport of said portable pedestal electric heater apparatus.

36. The portable pedestal electric heater apparatus of claim 35, wherein said riser further comprising at least two riser members, and in said non-operating position, each of said at least two riser members can be disconnected and separated from an adjacent riser member for compact storage.

37. The portable pedestal electric heater apparatus of claim 35, wherein in said non-operating position said vertically oriented space saving tower electric heater is disconnected and separated from said riser for compact storage.

38. The portable pedestal electric heater apparatus of claim 35, wherein said base further comprises a split base having at least a first portion and a second portion that can be separated for compact storage in said non-operating position and can be assembled to become said base in said operating position to support said elongate housing on said riser.

39. The portable pedestal electric heater apparatus of claim 35, wherein said riser further comprises a collapsible riser having at least two riser members, wherein said riser members have respective diameters different from one another such that each successive smaller diameter riser member slides into an adjacent riser member having a larger diameter, wherein in said non-operating position said riser members are collapsed, and in said operating position said riser members are adjustable between i) a minimum length where said riser members are substantially collapsed and ii) a maximum length where said riser members are extended apart from one another.

40. The portable pedestal electric heater apparatus of claim 35, wherein said air outlet opening further comprises an elongate air outlet opening in said at least one sidewall, said air outlet opening having a longitudinal length oriented substantially along said longitudinal length of said elongate housing.

41. The portable pedestal electric heater apparatus of claim 40, wherein said electric heating element further comprises an elongate electric heating element disposed proximate said elongate air outlet opening, said elongate electric heating element having a longitudinal length oriented substantially along said longitudinal length of said elongate housing.

42. The portable pedestal electric heater apparatus of claim 41, wherein said elongate electric heating element further comprises a vertical aspect ratio defined by a longitudinal length of said elongate electric heating element being greater than a width of said elongate electric heating element, said vertical aspect ratio of said elongate electric heating element being greater than about 2:1.

43. The portable pedestal electric heater apparatus of claim 42, wherein said elongate electric heating element has a longitudinal length of about 5 inches or greater.

44. The portable pedestal electric heater apparatus of claim 42, wherein said elongate electric heating element preferably has a longitudinal length of about 8 inches or greater.

45. The portable pedestal electric heater apparatus of claim 42, wherein said elongate electric heating element is a positive temperature coefficient (PTC) heating element capable of producing about 1500 watts of energy.

46. A portable pedestal electric heater apparatus having a tower electric heater mounted on top of a support riser, said tower electric heater further comprising:

a base for engaging a support surface;

a riser extending substantially vertically upward from said base to a distal end;

an elongate housing rotatably connected to said distal end of said riser and extending substantially vertically upward from said distal end of said riser, said elongate housing having a longitudinal length and a cross-sectional area, a ratio of said longitudinal length to a maximum width of said cross-sectional area being greater than about 1.5:1;

an air inlet in said elongate housing;

an air outlet opening in said elongate housing;

an air passageway in said housing fluidly coupling said air inlet to said air outlet opening;

an air blower assembly disposed within said elongate housing and in said air passageway between said air inlet and said air outlet openingt, said air blower assembly comprising:

an air impeller that rotates about a vertical axis of rotation;

a motor for rotating said air impeller;

an electric heating element disposed within said elongate housing and in said air passageway between said air blower assembly and said air outlet opening;

a heated exhaust air stream exiting said air outlet opening of said elongate housing a rotatable coupling disposed between said distal end of said riser and said elongate housing;

an oscillator for oscillating said elongate housing with respect to said base;

an axis of rotation about which said elongate housing rotates, wherein said axis of rotation is substantially aligned with said air impeller axis of rotation; and an elevation of said heated exhaust air stream of about 14 inches or greater facilitated by said base and said riser, wherein said elevation of said heated exhaust air stream is defined by a distance from where said base engages said support surface to a vertical midpoint of said air outlet opening in said vertically elongate housing;

wherein said substantial alignment of said axis of rotation of said elongate housing and said axis of rotation of said impeller reduces the effects of gyroscopic precession during an oscillation of said elongate housing and increases stability of said portable pedestal electric heater apparatus during oscillation;

wherein said riser comprises a structure for elevating said elongate housing above said support surface and does not comprise an electric heating element.

47. The portable pedestal electric heater of claim 46, further comprising:

an oscillation envelope of said elongate housing and defined by an area of movement of said elongate housing about said axis of rotation of said elonaate housing;

an oscillation envelope width centered about said axis of rotation of said elongate housing and defined by a maximum width of a horizontal cross-sectional area taken through said oscillation envelope; and a base width defined by a maximum width of a horizontal cross-section taken through said base;

wherein said oscillation envelope width is less than said base width.

48. The portable pedestal electric heater of claim 47, wherein said base width is less than about 18 inches.

49. The portable pedestal electric heater of claim 48, wherein said oscillation envelope width is less than 70% of said base width.

50. A portable pedestal electric heater comprising:

a base contacting a support surface;

a riser extending substantially vertically upward from said base;

an elongate housing attached to a distal end of said riser, said housing having a length and a width, said housing length being greater than said housing width and defining a vertical aspect ratio of said housing;

an air inlet in said housing for receiving a flow of inlet air;

an elongate air outlet opening in said housing for discharging an exhaust air stream, said air outlet opening having a length and a width, said air outlet opening length being greater than said air outlet opening width and defining a vertical aspect ratio of said air outlet opening, a vertical center of said air outlet opening being about 14 inches or greater above said support surface;

an air blower assembly disposed within said housing, said air blower assembly being in fluid communication with said air inlet and said air outlet opening; and an elongate heating element disposed within said housing between said air blower assembly and said air outlet opening for heating substantially all of said exhaust air stream, said elongate heating element comprising;

a pre-determined maximum wattage of about 1500 watts;

a pre-determined vertical length;

a predetermined horizontal width being less than one half the pre-determined vertical length thereby defining a vertical aspect ratio of said elongate heating element;

an area of said elongate heating element defined by said pre-determined vertical length and said pre-determined horizontal width;

a watt density defined by said maximum wattage and said area of said elongate heating element; and a substantially continuous, vertically oriented, elongate column of heated exhaust air that is discharged from said elongate air outlet opening of said single elongate housing, wherein said column of heated exhaust air has a length and a width, said length of said column of heated exhaust air being greater than said width of said column of heated exhaust air thereby defining a vertical aspect ratio of said column of heated exhaust air;

wherein said base and riser elevates said column of heated exhaust air absent the need to increase the pre-determined length of said electric heating element thereby maintaining said watt density of said elongate heating element for the purpose of heating substantially all of said exhaust air stream.

51. The portable pedestal electric heater according to claim 50, wherein said riser comprises a support structure absent an electric heating element.

52. The portable pedestal electric heater according to claim 50, wherein said air blower assembly further comprises a vertically elongate air impeller having a length and diameter to maintain flow characteristics of said exhaust air stream to effectively allow said watt-density of said elongate heating element to heat said exhaust air stream.

53. The portable pedestal electric heater apparatus according to claim 52, wherein said vertical aspect ratio of said elongate air impeller is greater than about 2:1.

54. The portable pedestal electric heater apparatus according to claim 50, wherein said vertical center of said air outlet opening is greater than about 70% of said length of said housing.

55. An oscillating, space saving, portable pedestal electric heater comprising:

a base having a center and a maximum width of a horizontal cross-sectional area of said base;

a riser having a longitudinal length and a center axis, said riser extending vertically upward from said base, wherein said riser comprises a support structure absent an electric heating element;

a tower electric heater comprising:

an elongate housing having a longitudinal length, a center axis, and a maximum width of a horizontal cross-sectional area of said elongate housing, said elongate housing extending vertically upward from said riser, and said center axis of said elongate housing being substantially aligned with said center axis of said riser;

an air blower assembly in said elongate housing, said air blower assembly comprising:

a motor;

an impeller;

an axis of rotation of said impeller that is substantially orthogonal to said center axis of said elongate housing;

an vertically elongate electric heating element disposed within said elongate housing, said vertically elongate electric heating element having a length and a width, said length of said vertically elongate electric heating element being substantially aligned with said longitudinal length of said elongate housing; and a heated exhaust air stream exiting said elongate housing, wherein a vertical midpoint of said heated exhaust air stream existing said elongate housing is about 14 inches or greater above a support surface;

wherein said air blower assembly is positioned in a lower portion of said elongate housing and said position of said air blower in said lower portion of said elongate housing lowers a center of gravity of said portable pedestal electric heater with respect to said support surface and increases the stability of said portable pedestal electric heater.

56. The portable pedestal electric heater according to claim 55, wherein the said lowered center of gravity and said increased stability allows said maximum width of said horizontal cross-sectional area of said base to be minimized with respect to said maximum width of said horizontal cross-sectional area of said elongate housing, resulting in further space-savings.

57. The portable pedestal electric heater according to claim 56, wherein said maximum width of said horizontal cross-sectional area of said elongate housing is less than about 70% of said maximum width of said horizontal cross-sectional area of said base.

58. The portable pedestal electric heater according to claim 56, wherein said maximum width of said horizontal cross-sectional area of said base is about 18 inches or less.

59. The portable pedestal electric heater apparatus of claim 1, wherein said riser comprises a support structure absent an electric heating element.

60. A method for elevating a vertically oriented column of heated air above a support surface for more immediately heating the upper portion of the human form, the method comprising the steps of:

providing a base for contacting a support surface;

extending a riser vertically upward from said base to a distal end;

providing an elongate housing defining an internal space having an air inlet and an air outlet, said elongate housing having a longitudinal length;

connecting said elongate housing to said distal end of said riser such that said longitudinal length of said elongate housing is oriented substantially vertically;

disposing an air blower assembly within said internal space between said air inlet and said air outlet;

disposing an electric heating element within said elongate housing between said air blower assembly and said air outlet;

generating an air flow into said air inlet using said air blower assembly;

subsequently passing said air flow through said air blower assembly and said electric heating element;

imparting thermal energy to said air flow passing through said electric heating element to form a vertically oriented column of heated air;

expelling said vertically oriented column of heated air out of said interior space of said elongate housing at an elevation above said support surface;

defining said elevation above said support surface as a distance greater than about 14 inches measured from said support surface to a vertical midpoint of said vertically oriented column of heated air; and shortening the distance of travel of said vertically oriented column of heated air from said air outlet to an upper portion of a user via a combination of said vertically oriented elongate housing and said vertically oriented riser.

61. The method for elevating a vertically oriented column of heated air above a support surface of claim 60, further comprising:

rotating an impeller of said air blower assembly about a vertically oriented axis of rotation;

oscillating said elongate housing about an axis of oscillation in substantial alignment with said vertically oriented axis of rotation of said impeller of said air blower assembly;

reducing the effect of gyroscopic rotation during an oscillation of said elongate housing and increases the stability of said vertically oriented column of heated air above said support surface, wherein said substantial alignment provides a reduced effect of gyroscopic rotation during an oscillation of said elongate housing and increases the stability of said vertically oriented column of heated air above said support surface.

62. The method for elevating a vertically oriented column of heated air above a support surface of claim 60, further comprising a non-operating position, said method further comprising:

disconnecting said base from said riser in a non-operating position;

disconnecting said riser from said elongate housing in a non-operating position;

disposing said riser and said elongate housing side by side in a shipping box thereby facilitating efficient transport.

63. The method for elevating a vertically oriented column of heated air above a support surface of claim 60, further comprising:

providing a watt density based upon a pre-determined vertical length of said electric heating element, a pre-determined horizontal width of said electric heating element and a pre-determined maximum wattage of said elongate electric heating element, wherein said pre-determined maximum wattage is about 1500 watts.

* * * * *

UNITED STATES PATENT AND TRADEMARK OFFICE

CERTIFICATE OF CORRECTION

PATENT NO. : 7,158,716 B2
APPLICATION NO. : 10/855697
DATED : January 2, 2007
INVENTOR(S) : Barry Shapiro et al.

It is certified that error appears in the above-identified patent and that said Letters Patent is hereby corrected as shown below:

Column 14, line 19 (Claim 1) – Please delete the following: "as said exhaust air stream"

Column 15, Line 20 (Claim 11) – Please delete the following: "comprisina" and replace with --comprising.--

Column 15, Line 50 (Claim 18) – Please delete the following: "nser" and replace with --riser--.

Column 16, Line 39 (Claim 30) – Please delete the following: "150" and replace with --1500.--

Column 17, Line 22 (Claim 35) – Please delete the following: "air blower assembly" and replace with --air impeller.--

Column 17, Line 26 (Claim 35) – Please delete the following: "eleftgate electric" and replace with --electric.--

Column 17, Line 29 (Claim 35) – Please delete the following: "i substantially" and replace with --substantially.--

Column 18, Line 61 (Claim 46) – Please delete the following: "openingt" and replace with --opening.--

Column 19, Line 32 (Claim 47) – Please delete the following: "elonaate" and replace with --elongate.--

Signed and Sealed this

Third Day of April, 2007

JON W. DUDAS
*Director of the United States Patent and Trademark Office*